US009037020B2

(12) United States Patent
Uekawa et al.

(10) Patent No.: US 9,037,020 B2
(45) Date of Patent: May 19, 2015

(54) IMAGE FORMING APPARATUS

(75) Inventors: Eiji Uekawa, Susono (JP); Yasuo Yoda, Numazu (JP); Yasunari Kobaru, Susono (JP); Takahiro Uchiyama, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 61 days.

(21) Appl. No.: 13/823,969

(22) PCT Filed: Dec. 9, 2011

(86) PCT No.: PCT/JP2011/079127

§ 371 (c)(1),
(2), (4) Date: Mar. 15, 2013

(87) PCT Pub. No.: WO2102/077830

PCT Pub. Date: Jun. 14, 2012

(65) Prior Publication Data

US 2013/0279930 A1 Oct. 24, 2013

(30) Foreign Application Priority Data

Dec. 10, 2010 (JP) ..... 2010-276169
Nov. 11, 2011 (JP) ..... 2011-247813

(51) Int. Cl.
*G03G 15/16* (2006.01)
*G03G 15/06* (2006.01)
*G03G 15/32* (2006.01)

(52) U.S. Cl.
CPC ..... *G03G 15/065* (2013.01); *G03G 15/325* (2013.01)

(58) Field of Classification Search
CPC ..... G03G 15/0291; G03G 15/0258; G03G 15/0266; G03G 21/105
USPC ..... 399/170, 357, 50, 73, 101, 66, 279, 121
See application file for complete search history.

(56) References Cited

U.S. PATENT DOCUMENTS 4,218,691 A 8/1980 Fujii
4,396,927 A 8/1983 Amaya et al.

(Continued)

FOREIGN PATENT DOCUMENTS

JP 57-132168 A 8/1982
JP 57-198473 A 12/1982

(Continued)

OTHER PUBLICATIONS

International Search Report mailed Apr. 2, 2012, in International Application No. PCT/JP2011/079127.

(Continued)

*Primary Examiner* — Roy Y Yi
(74) *Attorney, Agent, or Firm* — Fitzpatrick, Cella, Harper & Scinto

(57) ABSTRACT

An image forming apparatus includes a toner carrying member for carrying a toner; an image carrying member on which a toner image is formed with the toner; and a plurality of divided electrode portions provided at a position in which the electrode portions oppose the toner carrying member via the image carrying member interposed therebetween. The electrode portions are supplied with a voltage on the basis of image information to move the toner between the toner carrying member and the image carrying member thereby to form the toner image. The electrode portions includes a first electrode portion for forming an image portion and a second electrode portion, adjacent to the first electrode portion, for forming a non-image portion. The image forming apparatus further includes a controller for variably controlling at least one of potential differences |Vp−Vt| and |Vt−V0| depending on the image information, where a potential of the toner carrying member is Vt, a potential of the first electrode portion is Vp and a potential of the second electrode portion is V0.

6 Claims, 19 Drawing Sheets

(56) References Cited

U.S. PATENT DOCUMENTS

| | | | | |
|---|---|---|---|---|
| 5,053,793 | A | 10/1991 | White et al. | |
| 5,126,795 | A * | 6/1992 | Maruyama et al. | 399/231 |
| 2008/0069579 | A1 * | 3/2008 | Tabata et al. | 399/53 |

FOREIGN PATENT DOCUMENTS

| | | | |
|---|---|---|---|
| JP | 62-050849 | A | 3/1987 |
| JP | 62-249173 | A | 10/1987 |
| JP | 62-253464 | A | 11/1987 |
| JP | 3-8544 | B | 2/1991 |
| JP | 2003-103824 | A | 4/2003 |

OTHER PUBLICATIONS

Office Action in Chinese Patent Application No. 201180058659.7, dated Jan. 6, 2015.

* cited by examiner (a)

(b)

(a)

(b)

(a)

(b)

(a)

(b)

IMAGE FORMING APPARATUS

TECHNICAL FIELD

The present invention relates to an image forming apparatus for forming an image by carrying a toner on a recording material.

BACKGROUND ART

In a conventional copying machine or printer of an electrophotographic type, in general, a surface of a photosensitive member is electrically charged uniformly by a charging means and the uniformly charged surface of the photosensitive member is exposed to laser light, LED light or the like by an exposure means, so that an electrostatic latent image is written (formed) on the surface of the photosensitive member. After the electrostatic latent image is formed, the electrostatic latent image is developed by a developing means, so that an image is formed on the photosensitive member surface.

On the other hand, in order to downsize and simplify a constitution of the image forming apparatus, a plurality of examples of such an image forming apparatus that a plurality of recording electrodes arranged in a direction (scanning direction) perpendicular to a recording material conveyance direction are used to effect the development simultaneously with the latent image formation are disclosed.

For example, as represented by Japanese Patent Publication (JP-B) Hei 3-8544, in a multi-stylus printer using needle-like electrodes, an image forming electrode provided with a large number of needle-like electrodes and a cylindrical opposite electrode are oppositely disposed with a predetermined spacing (gap) in which a recording material is interposed in contact with the image forming electrode. In this state, a voltage corresponding to an image signal is applied to the image forming electrode to cause gap electric discharge, so that a toner image is formed.

Further, in a method as represented by Japanese Laid-Open Patent Application (JP-A) 2003-103824, first, by a plurality of writing electrodes contacting an inner surface of an image carrying member, electric charges are provided in a writing layer located at the inner surface of the image carrying member. Then, an electroconductive developing roller functions as the opposite electrode, so that an electrostatic latent image is formed on an electroconductive layer at the surface of the image carrying member. Simultaneously with the latent image formation, the latent image is developed with a developer on the developing roller, so that an image is formed.

In the above-described methods in which the development is effected simultaneously with the latent image formation by using the recording electrodes, a resolution of the image forming apparatus with respect to the scanning direction is determined by an interval between the plurality of divided recording electrodes. For example, in order to obtain the resolution of 600 dpi, the electrode interval is 42.3 μm. In order to realize a higher resolution, there is a need to decrease the electrode interval but there is a limit to realization of high density of the electrodes by fine processing technology. Therefore, there is a limit to realization of high resolution of the image by relying on only the decrease of the electrode interval.

On the other hand, in the image forming apparatus of the conventional type in which the electrostatic latent image is written on the surface of the photosensitive member by using the exposure means with the laser light or the LED light, in many cases, the image formation with the higher resolution is effected by modulation of lighting pulse or adjustment of light quantity. That is, width or length of the image for one pixel unit (dot) with respect to a main scan direction or a sub-scan direction is changed. These control operations are used in the case where serrated feeling represented in a stepwise shape when the image constituted by oblique lines or curved lines or the like is drawn or in the case where a not more than the resolution is intended to be faithfully reproduced. There are the case where the image forming apparatus automatically discriminates image information to perform the operations and the case where a user selects a high-resolution mode or the like to perform the operations.

The method of forming the image by using the above-described recording electrodes will be considered. When the image width for one pixel is tried to be adjusted by the control of a voltage applied to the electrodes, in the case of the multi-stylus type in which the electric charges are provided by the gap electric discharge, a charging property by the electric discharge is not uniform due to variation of the gap in the first place.

Further, in the method in which the electrostatic latent image is formed on the image carrying member surface as described in JP-A 2003-103824, a charge amount provided by adjusting the applied voltage is different, so that an amount of the developer subjected to the development is also changed. Therefore, reproducibility of the thin line or minute dot is poor and thus it is difficult to control clear image (dot) formation.

Accordingly, in an image forming process in which the development is effected simultaneously with the latent image formation by using the recording electrodes, the method of adjusting the image (dot) width for one pixel corresponding to the electrode interval has not been disclosed as yet.

DISCLOSURE OF THE INVENTION

A principal object of the present invention is to provide an image forming apparatus capable of forming an image (dot) with a resolution higher than a resolution corresponding to an electrode interval in an image forming process in which development is effected simultaneously with latent image formation by using recording electrodes.

According to an aspect of the present invention, there is provided an image forming apparatus comprising: a toner carrying member for carrying a toner; an image carrying member on which a toner image is formed with the toner; a plurality of divided electrode portions provided at a position in which the electrode portions oppose the toner carrying member via the image carrying member interposed therebetween, wherein the electrode portions are supplied with a voltage on the basis of image information to move the toner between the toner carrying member and the image carrying member thereby to form the toner image, and wherein the electrode portions includes a first electrode portion for forming an image portion and a second electrode portion, adjacent to the first electrode portion, for forming a non-image portion; and a controller for variably controlling at least one of potential differences $|Vp-Vt|$ and $|Vt-V0|$ depending on the image information, where a potential of the toner carrying member is Vt, a potential of the first electrode portion is Vp and a potential of the second electrode portion is V0.

These and other objects, features and advantages of the present invention will become more apparent upon a consideration of the following description of the preferred embodiments of the present invention taken in conjunction with the accompanying drawings.

Figure 2:
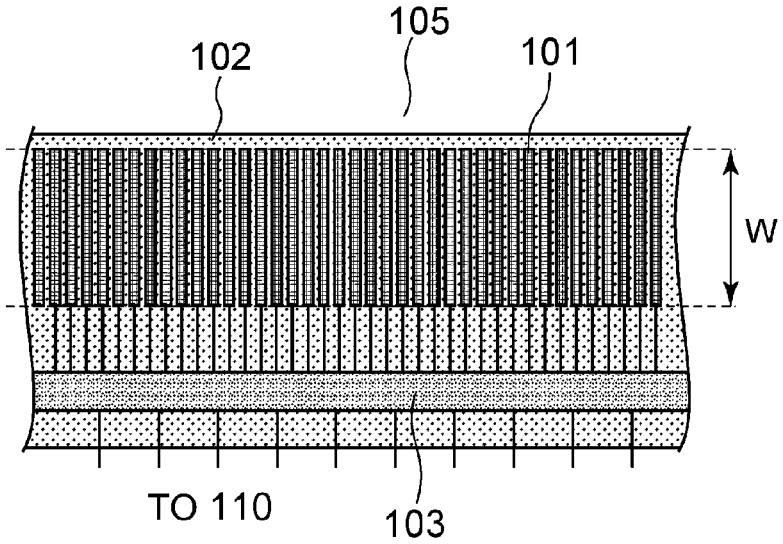
Figure 2:
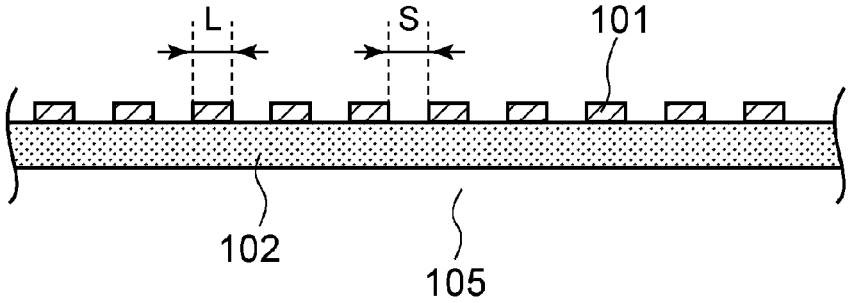

Parts (a) and (b) of FIG. 2 are schematic illustrations of an image forming electrode in Embodiment 1.

Figure 3:
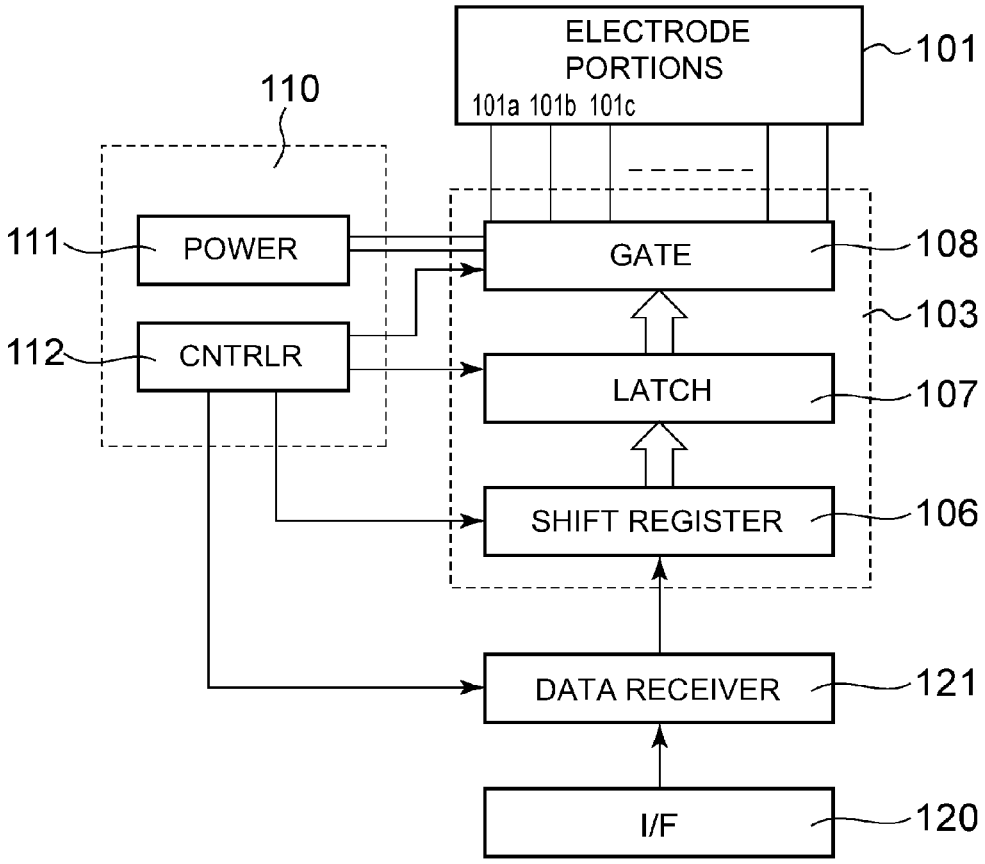

FIG. 3 is a schematic illustration of the image forming electrode in Embodiment 1.

Figure 4:
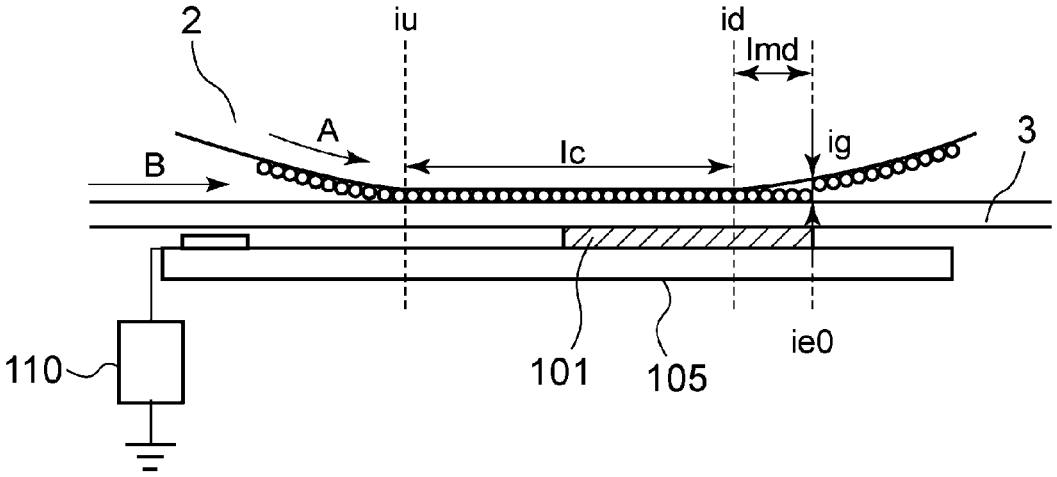

FIG. 4 is an enlarged schematic illustration of an image forming portion where the image forming electrode in Embodiment 1 is disposed.

Figure 5:
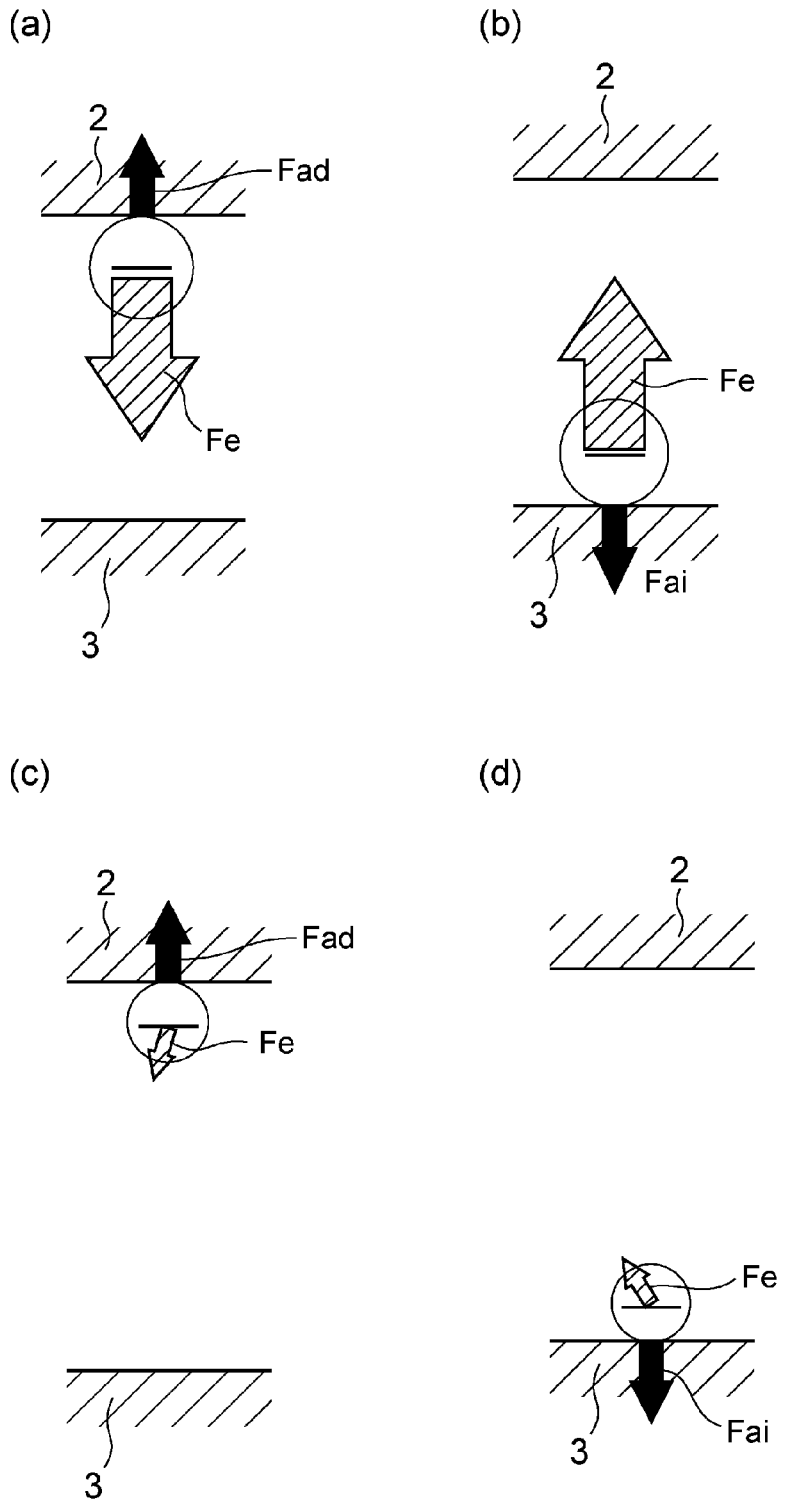

Parts (a) to (d) of FIG. 5 are schematic model views for illustrating forces acting on a toner.

Figure 6:
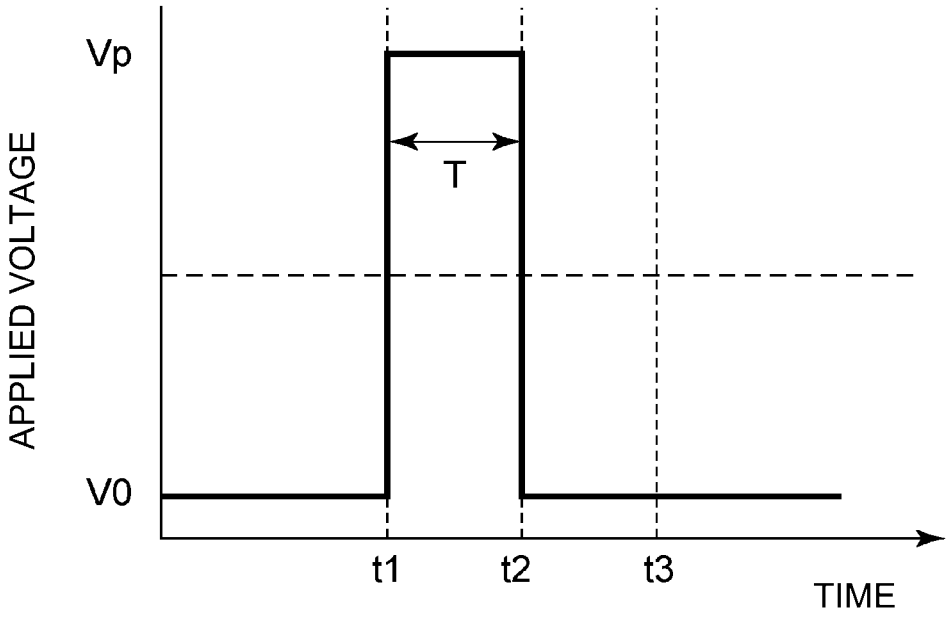

FIG. 6 is a timing chart of a voltage applied to the image forming electrode.

Figure 7:
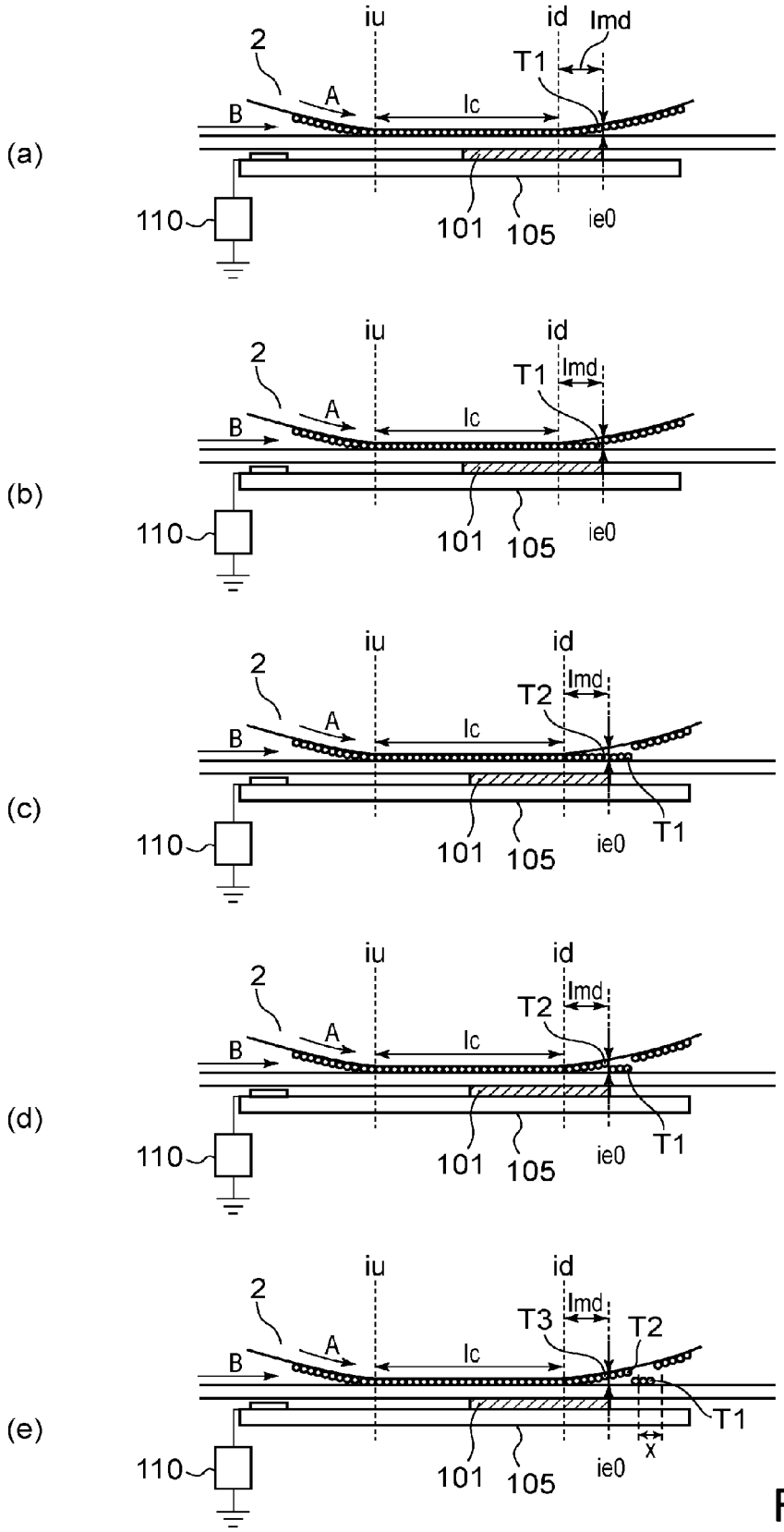

Parts (a) to (e) of FIG. 7 are schematic illustrations showing a toner state between a toner carrying roller and an image carrying member in Embodiment 1.

Figure 8:
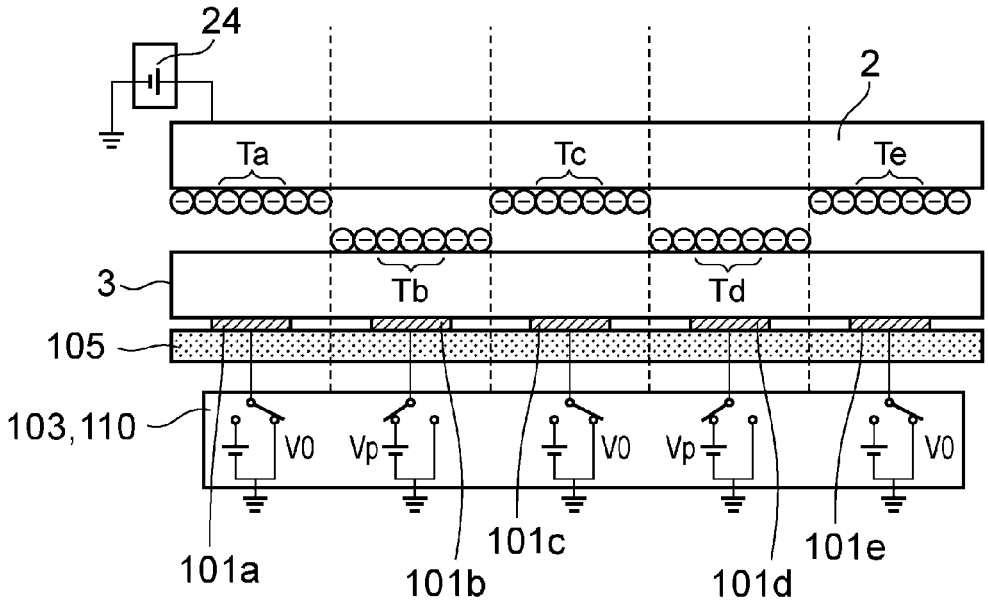
Figure 8:
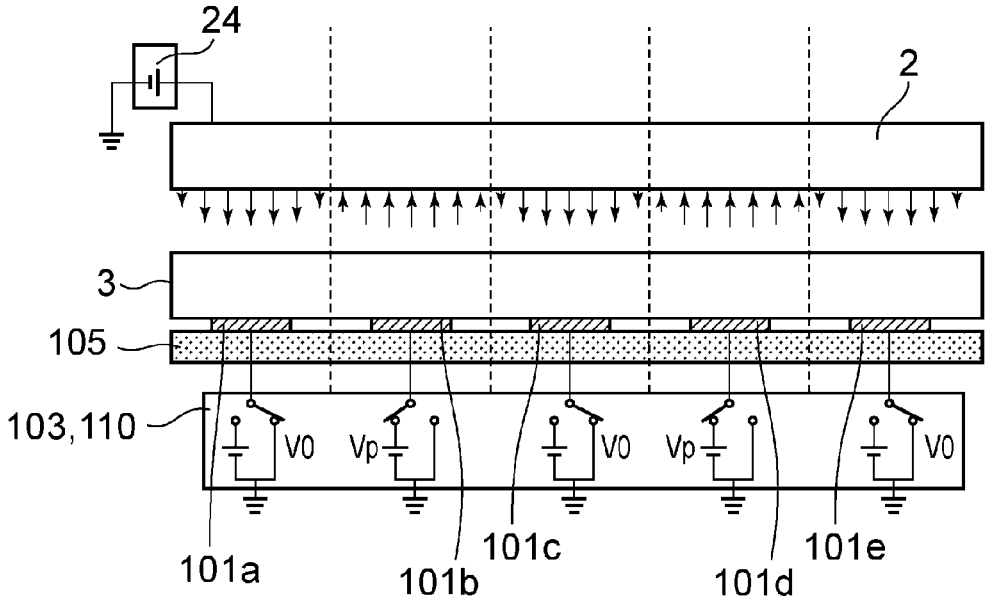

Parts (a) and (b) of FIG. 8 are enlarged schematic illustrations showing the toner state between the toner carrying roller and the image carrying member in Embodiment 1.

Figure 9:
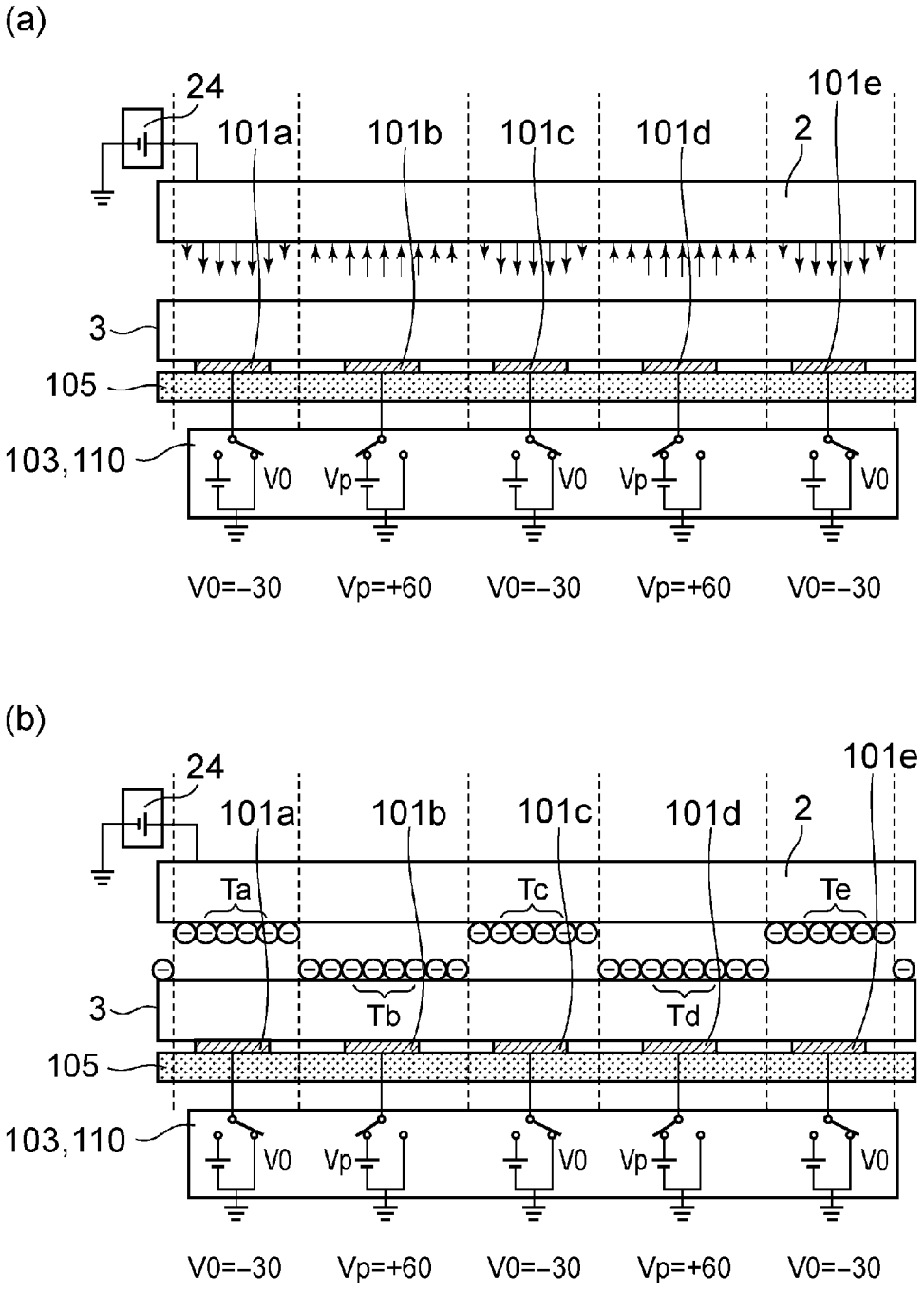

Parts (a) and (b) of FIG. 9 are enlarged schematic illustrations showing the toner state between the toner carrying roller and the image carrying member in Embodiment 1.

Figure 10:
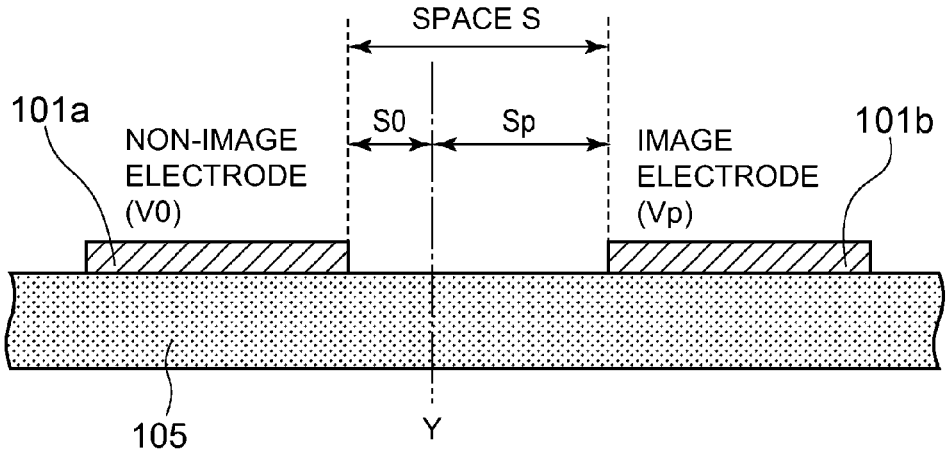

FIG. 10 is a schematic view showing a space between electrodes and a position of electric field change point in Embodiment 1.

Figure 11:
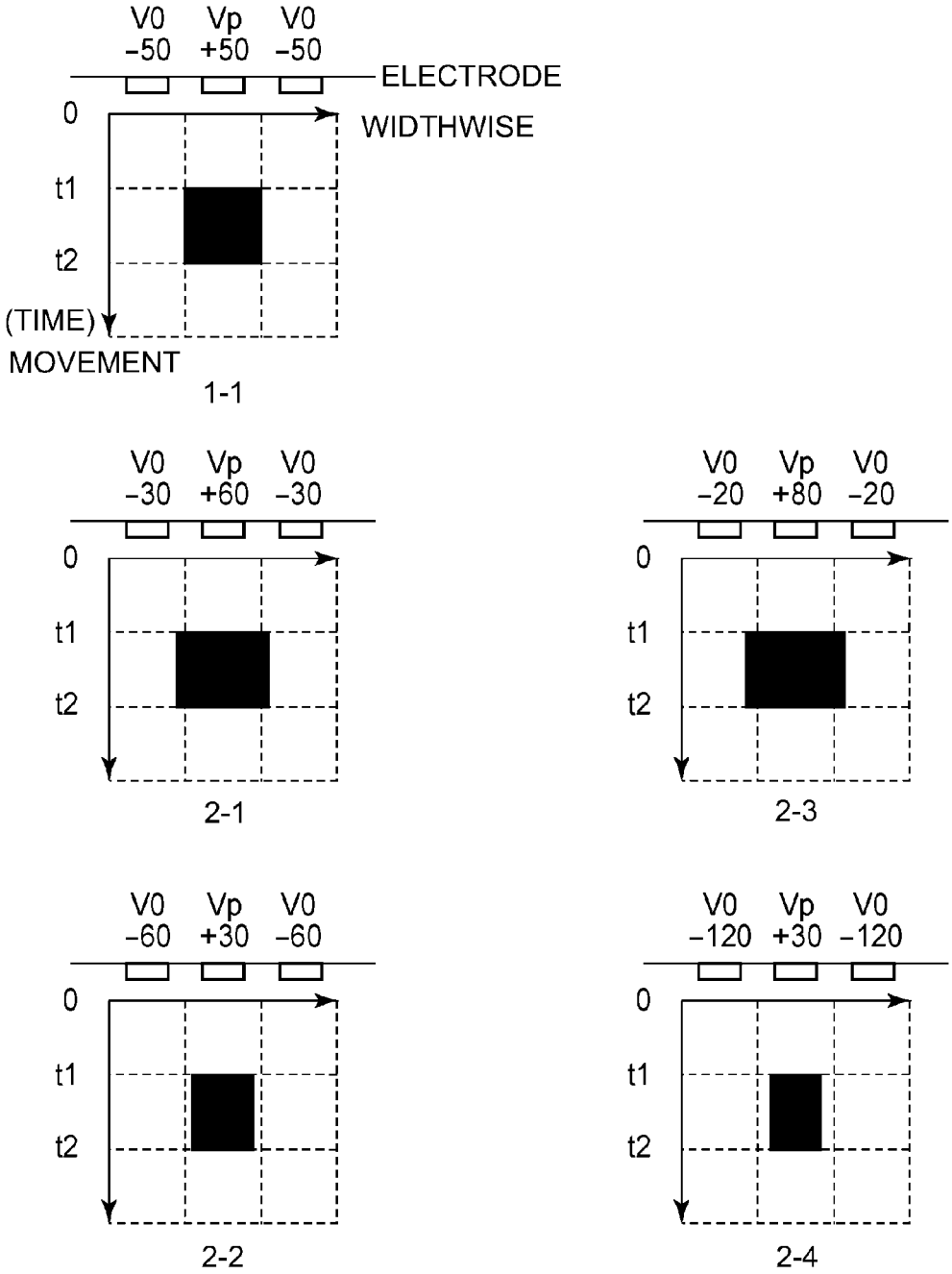

FIG. 11 includes schematic views each showing an example of an image for one pixel (dot) in Embodiment 1.

Figure 12:
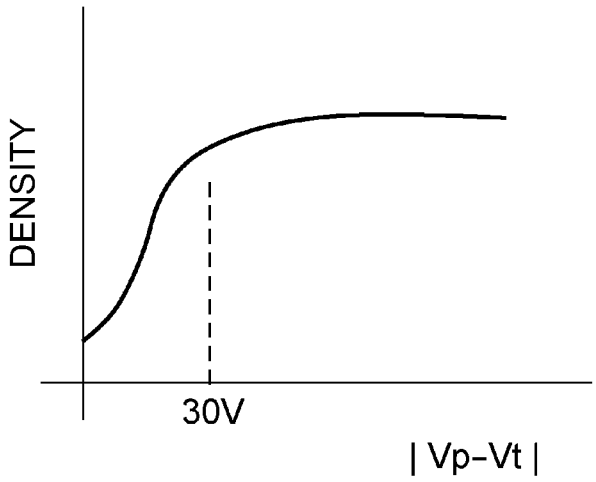
Figure 12:
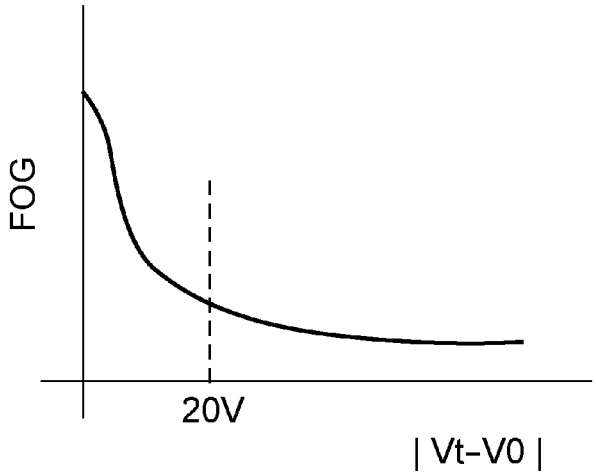

Parts (a) and (b) of FIG. 12 are schematic views for illustrating a control range of an applied voltage in Embodiment 1.

Figure 13:
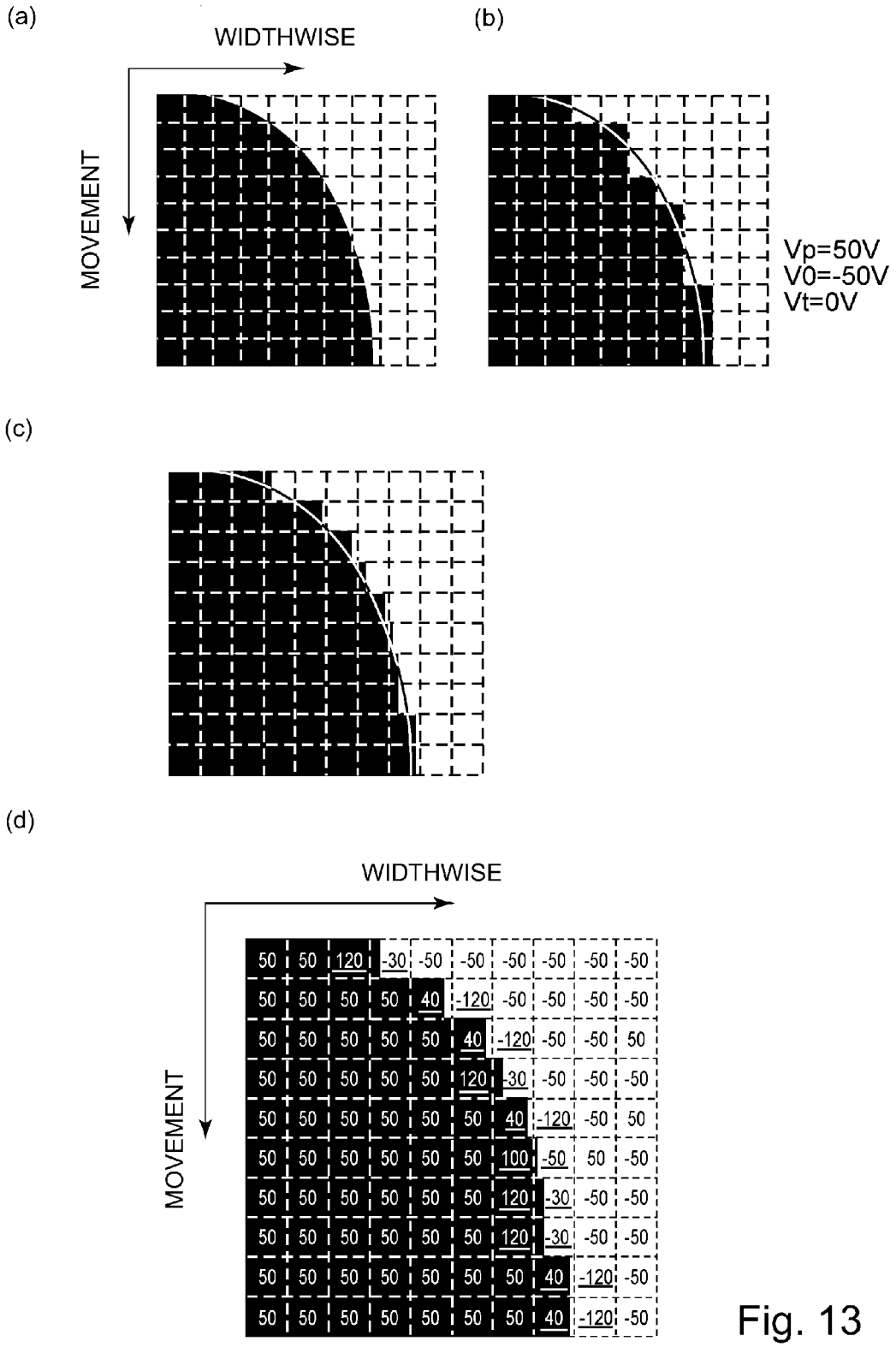

Parts (a) to (d) of FIG. 13 are schematic views for comparing an effect in Embodiment 1.

Figure 14:
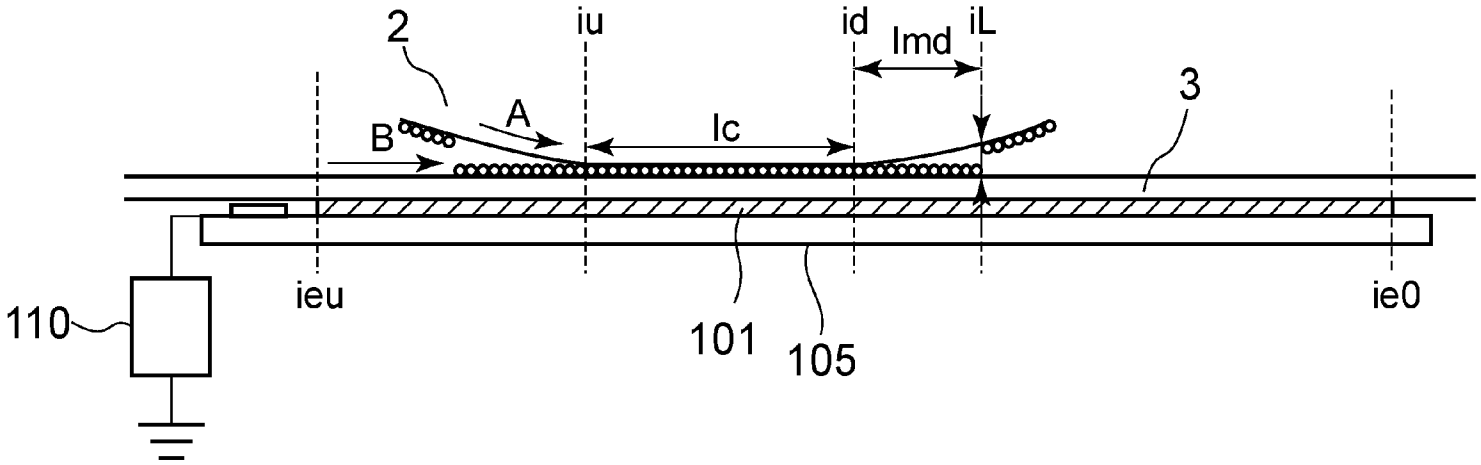

FIG. 14 is a schematic illustration, of an image forming electrode, showing another example in Embodiment 1.

Figure 15:
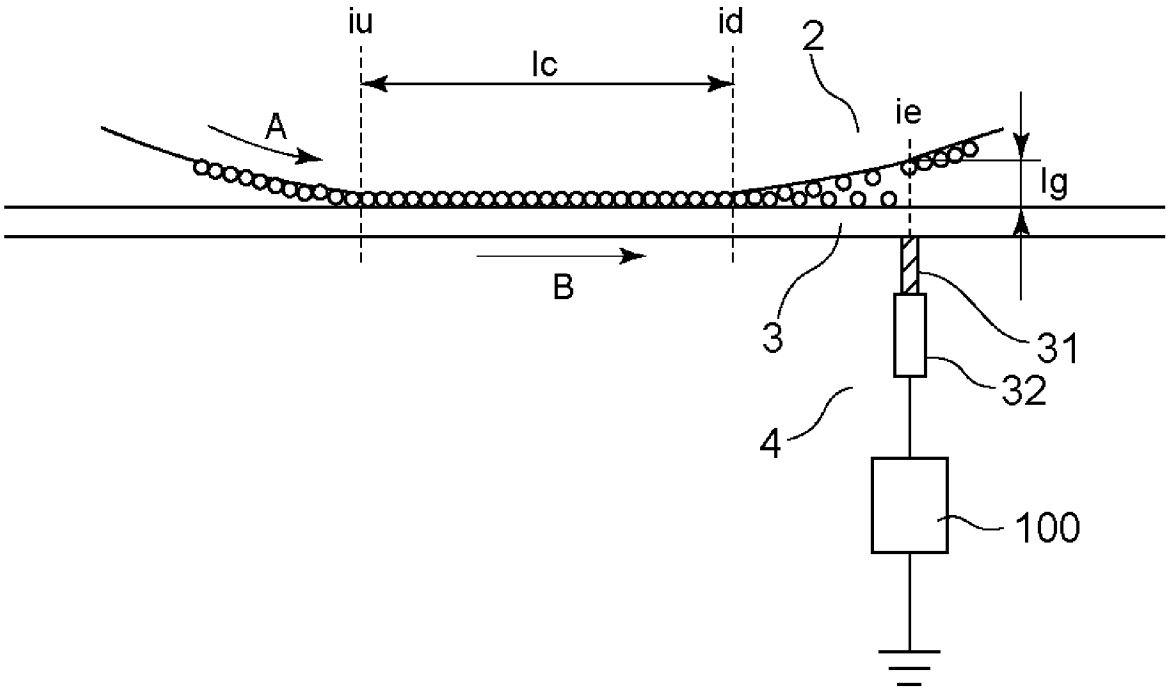

FIG. 15 in a schematic illustration, of an image forming electrode, showing another example in Embodiment 1.

Figure 16:
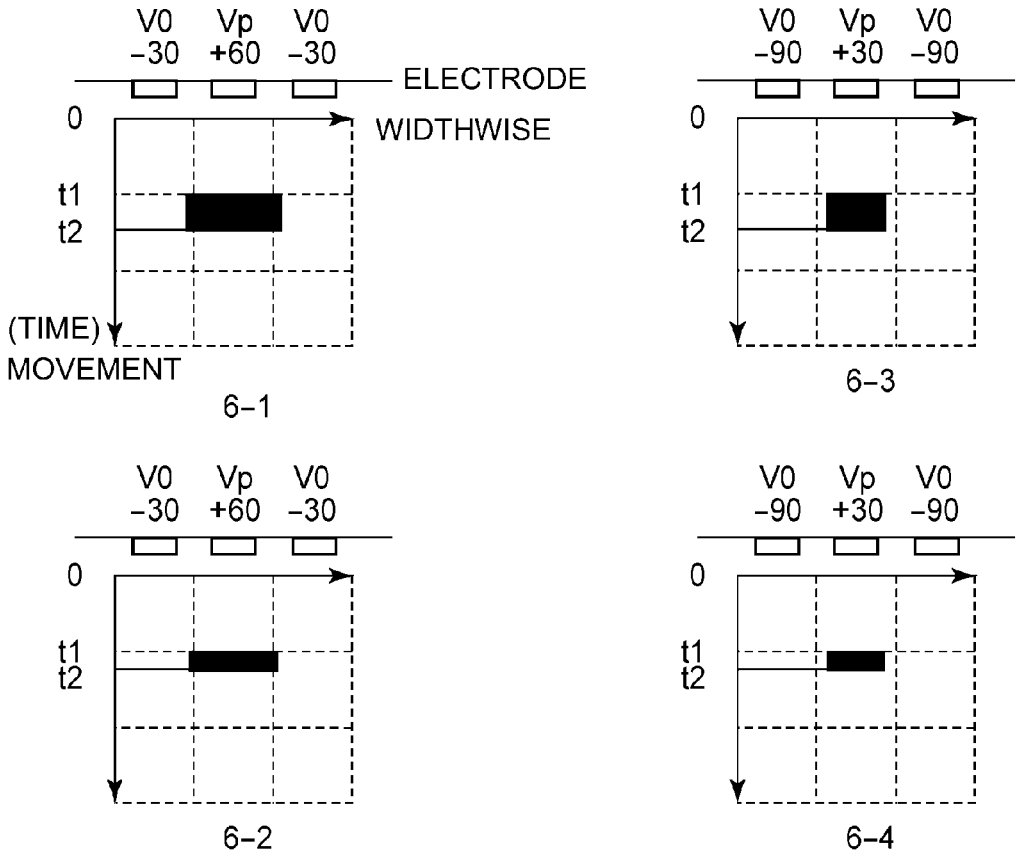

FIG. 16 includes schematic views each showing an example of an image for one pixel (dot) in Embodiment 2.

Figure 17:
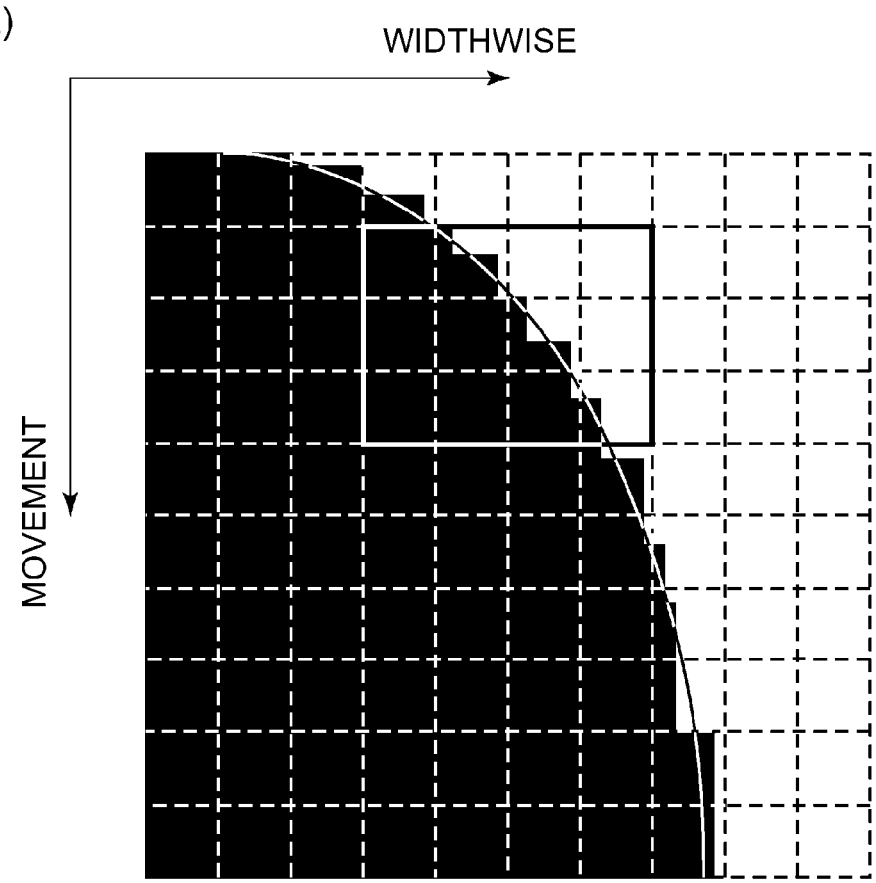
Figure 17:
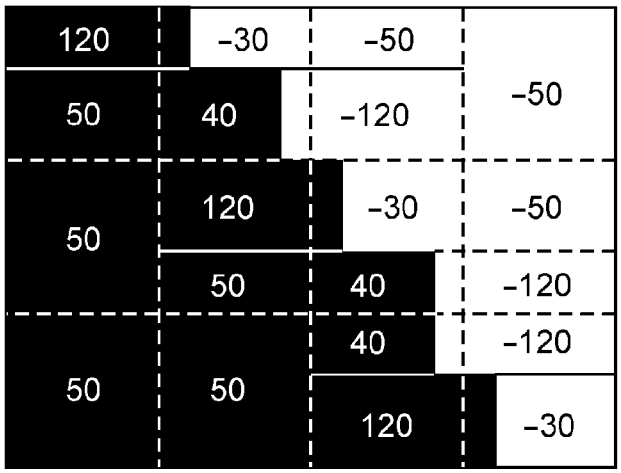

Parts (a) and (b) of FIG. 17 are schematic views for illustrating an effect in Embodiment 2.

Figure 18:
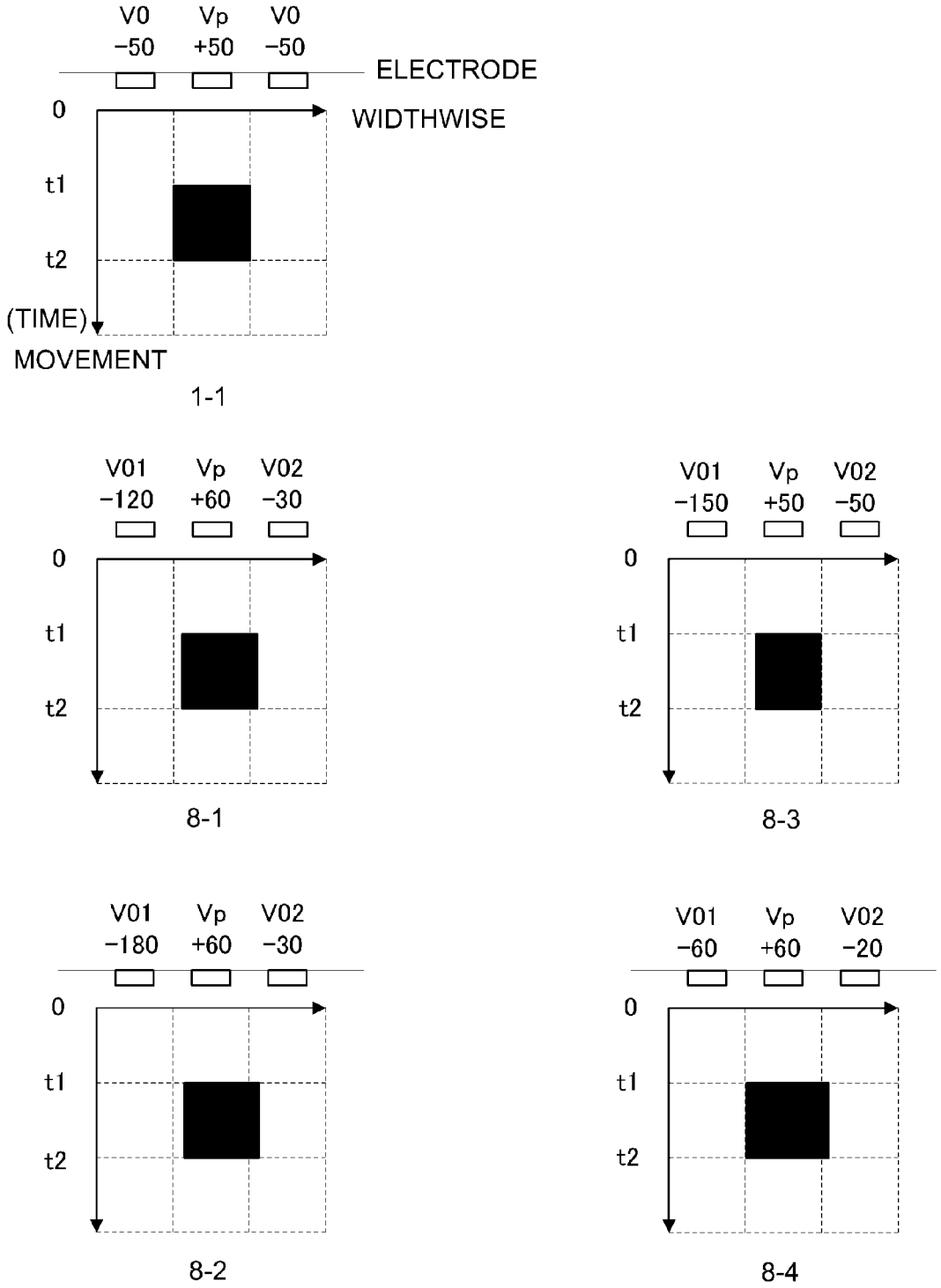

FIG. 18 includes schematic views each showing an example of an image for one pixel (dot) in Embodiment 3.

Figure 19:
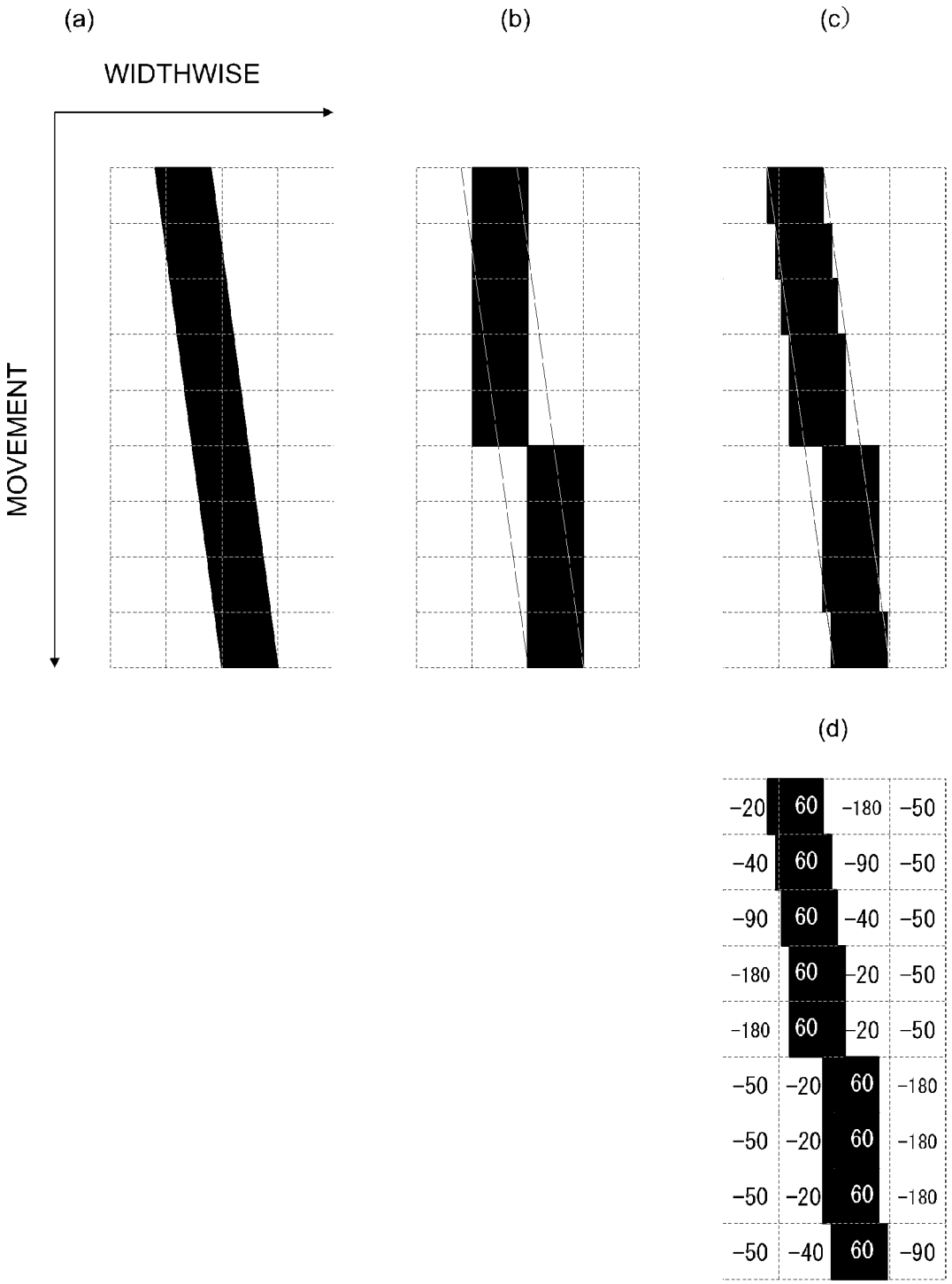

Parts (a) to (d) of FIG. 19 are schematic views for illustrating an effect in Embodiment 3.

BEST MODE FOR CARRYING OUT THE INVENTION

Embodiment 1

Embodiment 1 of the present invention will be described with reference to the drawings.

Figure 1:
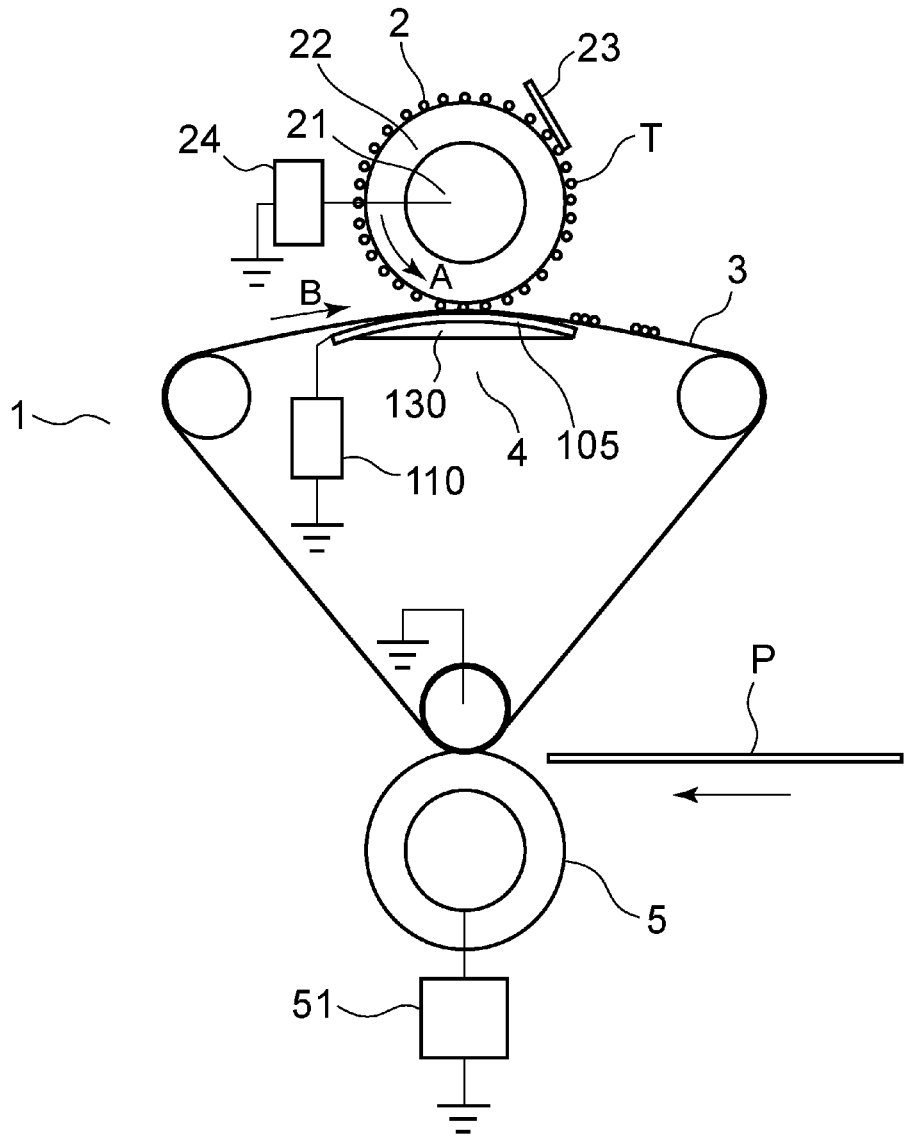
FIG. 1 is a schematic illustration of an image forming apparatus applicable to Embodiment 1.

FIG. 1 is a schematic illustration of an image forming apparatus in this embodiment to which the present invention is applicable.

In FIG. 1, an image forming apparatus 1 includes a toner carrying roller (toner carrying member) 2 for carrying and conveying a toner at its outer peripheral surface, an image carrying member 3 on which an image of the toner T is to be formed, an image forming electrode portion 4 to which a voltage is applied thereby to form a toner image based on image information on the image carrying member 3, and a transfer roller 5 as a transfer member for transferring the toner image from the image carrying member 3 onto a recording material P such as paper.

The toner carrying roller 2 is rotationally driven in an arrow A direction, and carries the toner T on its outer peripheral surface and conveys the toner T to an image forming portion and also functions as an opposite electrode to the image forming electrode portion 4. The toner carrying roller 2 is 11.5 mm in outer diameter and is prepared by forming an electroconductive silicone rubber layer as an elastic layer 22 on a core metal of 6 mm in outer diameter as an electroconductive support 21 and by coating the surface of the electroconductive silicone rubber layer with a 10 μm-thick urethane resin layer.

The toner T is supplied from an unshown toner container and is electrically charged to a predetermined charge amount by a blade 23 and is regulated in a predetermined thickness on the outer peripheral surface of the toner carrying roller 2.

The blade 23 is contacted to the toner carrying roller 2 by using spring elasticity of a thin metal plate constituting the blade 23. In this embodiment, a 0.1 mm-thick plate of SUS and phosphor bronze was used.

The toner T is a non-magnetic one component toner having an average particle size of 6 μm, a specific resistance of about $10^{16}$ Ω·cm and a negative charge polarity. Incidentally, the charge polarity of the toner on the toner carrying roller 2 is a normal charge polarity of the toner. In this embodiment, the negative charge polarity is the normal charge polarity.

Further, a toner carrying roller power source 24 is connected to the electroconductive support 21 of the toner carrying roller 2 and is constituted so as to apply a voltage to the toner carrying roller 2 for maintaining a potential of the toner carrying roller 2 or so as to ground the toner carrying roller 2.

The image carrying member 3 for forming the toner image by transferring the toner from the toner carrying roller 2 and is an endless but having an electroconductivity with a resistance adjusted in a predetermined range. The image carrying member 3 is rotationally moved in an arrow B direction at a predetermined process speed. Hereinafter, the arrow B direction is referred to as an image carrying member movement direction. Further, a direction (perpendicular to the drawing sheet) crossing the image carrying member movement direction is referred to as an image carrying member widthwise direction.

The image carrying member 3 in a single-layer polyimide film of 50 μm in thickness and $10^{8.5}$ Ω·cm in resistance value.

The image forming electrode portion 4 is provided in a plurality of portions arranged along the image carrying member widthwise direction and is prepared by fixedly supporting planar electrode 105 on a supporting member 130 at regular intervals. The image forming electrode portion 4 is disposed in contact with the inner surface of the image carrying member 3 at a predetermined pressure.

Further, the planar electrode 105 is connected to an image forming electrode controller 110, and the image forming electrode voltage controller 110 effects control so that a value of a voltage applied to the planar electrode 105 is changed on the basis of image information.

Details of the planar electrode 105 will be described later.

Image formation in this embodiment is effected by moving the toner T on the toner carrying roller (ME) 2 between the toner carrying roller 2 and the image carrying member 3 through the electric field of the voltage applied to the planar electrode 105.

The toner image on the image carrying member 3 is transferred with predetermined timing onto the recording material P such as paper by the transfer roller 5. The recording material P is conveyed to a transfer portion between the image carrying member 3 and the transfer roller 5. When the recording material P is located at the transfer portion, a transfer bias is applied to the transfer roller 5 by a transfer bias control means 51, so that the toner image is transferred from the image carrying member 3 onto a predetermined position of the recording material P.

(2) Planar Electrode

Parts (a) and (b) of FIG. 2 are schematic illustrations showing a portion of the planar electrode 105, wherein (a) is a schematic illustration as seen from an image carrying member contact surface, and (b) is a schematic sectional view with respect to the image carrying member widthwise direction.

As shown in (a) of FIG. 15, the planar electrode 105 is constituted by an insulating electrode base material 102, a plurality of electrode portions 101 formed on the electrode base material 102 in contact with the image carrying member, and an electrode driving portion 103 connected to the electrode portions 101.

The electrode portions 101 are constituted by a plurality of electrodes divided (separated) along the image carrying member widthwise direction. Each electrode portion has a width W with respect to the image carrying member movement direction and is formed in a rectilinear line shape extending in the image carrying member movement direction.

As shown in (b) of FIG. 2, the electrode portions 101 are formed on the entire image forming area of the electrode base material with an electrode width L for each electrode at an electrode interval S between adjacent electrodes.

The planar electrode 105 used in this embodiment is a flexible print board. The electrode base material 102 is formed of polyimide in a thickness of 25 μm and thereon the electrode portions 101 are formed with copper electrodes in a thickness of 10 μm. The electrode portions 101 have the electrode width L of 40 μm for each electrode and the electrode interval S of 40 μm.

Further, the electrode portions 101 are connected to an image forming electrode voltage controller 110 via the electrode driving portion 103, and the controller 110 contacts and applies a voltage based on image information to the respective electrode portions 101 with predetermined timing, thus effecting the image formation.

FIG. 3 is a block diagram showing a constitution of the electrode portions in this embodiment.

The image information is inputted into an interface (I/F) 120 and data of the image information is received by a data receiving portion 121 and is sent to the electrode driving portion 103. The electrode driving portion 103 is constituted by a shift register 106 for converting the transferred image information, a latch 107 for holding an output state of the shift register 106, and a gate 108 for switching an output applied from an electrode power (voltage) source 111 to each of the electrodes of the planar electrode portion.

The electrode power source 111 is connected to the respective electrode portions (101*a*, 101*b*, 101*c*, . . . ) of the electrode portions 101 via the gate 108 to supply the image forming voltage Vp and the non-image forming voltage V0 to the electrode portions 101.

A controller 112 controls the data receiving portion 121, the shift register 106, the latch 107 and the gate 108 and controls the voltage applied to each electrode of the electrode portions depending on the image information inputted from the interface (I/F) 120, thus effecting the image formation.

(3) Details of Image Forming Portion

FIG. 4 is an enlarged schematic illustration of the image forming portion where the planar electrode 105 is disposed. In the toner contact area Ic, the planar electrode 105 has a substantially flat surface as shown in FIG. 4.

In FIG. 4, in the toner contact area Ic, the toner T on the toner carrying roller 2 contacts the image carrying member 3. The position iu is the upstream position of the toner contact area Ic with respect to the image carrying member movement direction, and the position id is the downstream position of the toner contact area Ic with respect to the image carrying member movement direction.

The position ie0 is an electrode contact downstream position which is the downstreammost position, of the electrode portions 101 contacting the image carrying member 3, with respect to the image carrying member movement direction.

In a toner movement area (toner movable area) Imd, the toner is moved between the toner carrying roller 2 and the image carrying member 3. The downstream position id of the toner contact area is a downstreammost position of Imd.

Further, the electrode contact downstream position ie0 is located downstream of the toner contact area Ic with respect to the image carrying member movement direction. The operation in this embodiment is performed by moving the toner between the toner carrying roller (member) 2 and the image carrying member 3 by the electric field between the toner carrying roller 2 and the image carrying member 3. The toner movement is effected in the toner movement area Imd.

When the gap between the toner carrying roller 2 and the image carrying member 3 at the position of the planar electrode 105 is a toner carrying member gap Tg, the electric field acting on the toner can be made larger with a smaller toner carrying member gap Ig.

In the present invention, by employing the constitution in which the toner contact area Ic is provided, the toner carrying member gap Tg is gradually increased from the toner contact area Ic, so that a narrow gap between the electrode portions 101 and the toner carrying roller 2 can be created at the electrode contact downstream position ie0.

By the above constitution, the electric field between the toner carrying roller 2 and the electrode portions 101 can be strengthen, so that the toner can be moved at a low image forming voltage.

In this embodiment, in the toner movement area Imd, the image forming voltage and the non-image forming voltage are set at values at which no electric discharge occurs in the gap between the toner carrying roller 2 and the image carrying member 3.

In the constitution in this embodiment, when the voltage applied to the planar electrode is increased, in accordance with the Paschen's law, the electric discharge phenomenon occurs in a toner carrying member gap Ig of the planar electrode. The toner on the toner carrying roller 2 is negatively charged with a predetermined charge amount but when the electric discharge phenomenon occurs in the toner carrying member gap Ig, positive toner is generated by polarity inversion due to the electric discharge. The movement of the positive toner generated by the polarity inversion cannot be controlled by the electric field of the planar electrode 105, so that good image formation cannot be effected. Therefore, the image formation is effected by controlling the voltage applied to the planar electrode 105 so that a potential difference between the toner carrying roller 2 and the image carrying member 3 is not more than an electric discharge start voltage. In other words, even when the applied voltage is not more than the electric discharge start voltage, there is a need to cause the electric field acting on the toner to sufficiently function. For that purpose, narrow setting of the toner carrying member gap Ig at the electrode contact downstream position ie0 is important. The means therefor is achieved by realizing a constitution in which the toner carrying member gap Ig is gradually increased from the toner contact area Ic.

(4) Details of Image Forming Process (Image Forming Process with Respect to Image Carrying Member Movement Direction)

The image forming process with respect to the image carrying member movement direction will be described in the reference to schematic model views of (a) to (d) of FIG. 5.

Parts (a) and (b) of FIG. 5 show forces acting on the toner in the toner movement area Imd, and (c) and (d) of FIG. 5 show forces acting on the toner at the position downstream of the toner movement area Imd. A non-electrostatic deposition force between the toner T and the toner carrying roller 2 is a toner carrying roller deposition force Fad, and a non-electrostatic deposition force between the toner T and the image carrying member 3 is an image carrying member deposition force Fai. The electrostatic force acting on the toner T by the electric field between the image carrying member 3 and the toner carrying roller 2 is an electrostatic force Fe.

<Toner in Toner Movement Area Imd>

Part (a) of FIG. 5 is the model view when the image forming voltage Vp is applied to the electrode portion 101, and (c) and (d) of FIG. 5 are the model views when the non-image forming voltage V0 is applied to the electrode portions 101.

The toner T is in both of the carried state by the toner carrying roller 2 and the carried state by the image carrying member 3, depending on the previous voltage state applied to the electrode portions 101.

When the image forming voltage Vp is applied to the electrode portions 101 as shown in (a) of FIG. 5, the electrostatic force Fe toward the image carrying member act on the toner T by the electric field between the image carrying member 3 and the toner carrying roller 2. The electric field satisfying the following formula (1) is caused to act on the toner T, so that the toner T is moved from the toner carrying roller 2 to the image carrying member 3.

$$Fe>Fad \quad (1).$$

When the non-image forming voltage V0 is applied to the electrode portions 101 as shown in (b) of FIG. 5, the electrostatic force Fe toward the toner carrying roller 2 act on the toner T. The electric field satisfying the following formula (2) is caused to act on the toner T, so that the toner T is moved from the image carrying member 3 to the toner carrying roller 2 and thus the toner image is not formed on the image carrying member 3.

$$Fe>Fai \quad (2).$$

<Toner at Position Downstream of Toner Movement Area Imd with Respect to Image Carrying Member Movement Direction>

Part (c) of FIG. 5 is the model view when the image forming voltage Vp is applied to the electrode portions 101 at the position downstream of the toner movement area Imd with respect to the image carrying member movement direction, and (d) of FIG. 5 is the model view when the non-image forming voltage V0 is applied to the electrode portions 101 at the position downstream of the toner movement area Imd with respect to the image carrying member movement direction.

In either case, the gap between the electrode portions 101 and the toner carrying roller 2 is increased and therefore the electrostatic force Fe by the electric field is weak, so that the following formula (3) is satisfied and the toner cannot be moved.

$$Fe<Fad \text{ and } Fe<Fai \quad (3)$$

Therefore, the toner located downstream of the toner movement area Imd with respect to the image carrying member movement downstream is kept in the toner carrying state at the electrode contact downstream position ie0.

As described above, the toner movement in the toner movement area Imd is finally determined by the voltage when the toner is located at the electrode contact downstream position ie0, so that the toner image formation or the non-toner image formation is selected. Details will be described in an easy-to-understood manner.

For example, FIG. 6 shows an example of a timing chart of the voltage applied to the toner movement area Imd. In this example, the image forming voltage Vp is applied for a time T(s) from a time t1 to a time t2 after the non-image forming voltage V0 is applied to the planar electrode 105, and thereafter the non-image forming voltage V0 is applied again.

Parts (a) to (e) of FIG. 7 are schematic views showing the toner state between the toner carrying roller and the image carrying member.

At the time t1, the toner state is switched from a state where the non-image forming voltage V0 is applied to the electrode portions 101 until that time to a state of application of the image forming voltage Vp. The direction of the electric field between the electrode portions 101 and the toner carrying roller 2 and thus the direction of the electrostatic force is changed from the direction toward the toner carrying roller 2 to the direction toward the image carrying member 3, so that the toner state of (a) of FIG. 7 is changed to the toner state of (b) of FIG. 7. The toner passing through the electrode contact downstream position ie0 until the time t1 is not influenced by the electric field, so that the toner is carried on the toner carrying roller. With a toner T1 at the electrode contact downstream position ie0 as a leading end, the toner upstream of the toner T1 is moved onto the image carrying member.

At the time t2, the toner state is switched from a state where the image forming voltage Vp is applied for the time T(s) to a state of application of the non-image forming voltage V0. The direction of the electrostatic force is changed from the direction toward the image carrying member 3 to the direction toward the toner carrying roller 2, so that the toner state of (c) of FIG. 7 is changed to the toner state of (d) of FIG. 7. The toner passing through the electrode contact downstream position ie0 for the time T(s) is not influenced by the electric field, so that the toner is moved in the downstream direction while being held on the image carrying member. With a toner T2 at the electrode contact downstream position ie0 as a leading end, the toner upstream of the toner T2 is moved onto the toner carrying roller 2.

At a time t3, from the time t2, the non-image forming voltage V0 is still applied as it is and therefore the toner is not moved in the toner movement area Imd, thus passing through the electrode contact downstream position ie0 while being held on the toner carrying member. The toner image formed on the image carrying member from the time t1 to the time t2 is kept in the held state and is moved in the downstream direction for a time from the time t2 to the time t3 ((e) of FIG. 7).

Here, the image carrying member is moved in the arrow B direction at a process speed V (mm/s), so that it is possible to form the image with a width of X=V×T (mm) on the image carrying member.

(Image Forming Process with Respect to Image Carrying Member Widthwise Direction)

The image forming process with respect to the image carrying member widthwise direction will be described.

Part (a) of FIG. 8 is an enlarged schematic model view showing a toner state between the toner carrying roller 2 and the image carrying member 3 in the toner movement area Imd of the planar electrode 105 and partly showing the toner state with respect to the image carrying member widthwise direction.

In the toner state, the image forming voltage Vp is applied to the electrode portions 101*b* and 101*d* and the non-image forming voltage V0 is applied to the electrode portions 101*a*, 101*c* and 101*e*. Part (b) of FIG. 8 shows the electric field at the toner carrying member surface the toner carrying roller 2 and the image carrying member 3.

In (a) and (b) of FIG. 8, with respect to the image carrying member widthwise direction, the plurality of electrode portions 101*a* and 101*e* of the planar electrode 105 are arranged with the width and interval depending on a resolution of the image forming apparatus 10, and are disposed in contact with the image carrying member 3.

The toner T (Ta to Te) is negatively charged. The toners corresponding to electric fields at the electrode portions 101*a* to 101*d* are Ta to Te, respectively.

In (b) of FIG. 8, the electric field intensity is represented by a direction and length of each arrow.

Next, the voltage applied to the electrode portions 101 when an image width (dot width) for one pixel depending on the resolution of the image forming apparatus will be described. In (a) of FIG. 8, each of the images formed with the toners Tb and Td corresponding to the electrode portions 101*b* and 101*d* is a dot for one pixel, and each of portions corresponding to the electrode portions 101*a*, 101*b* and 101*c* is a space for one pixel. The toner carrying roller 2 is kept at 0 V by the toner carrying roller power source 24.

The image forming voltage Vp of +150 V is selectively applied depending on the image information to the electrode portions 101 in an image forming area, and the non-image forming voltage V0 of −150 V is selectively applied to the electrode portions 101 in a non-image forming area. The image forming voltage Vp is a voltage, applied to the electrode portions 101, of an opposite polarity to the toner charge polarity with respect to the potential of the toner carrying roller 2. The non-image forming voltage 10 is a voltage, applied to the electrode portions 101, of identical polarity to the toner charge polarity with respect to the potential of the toner carrying roller 2.

As shown in (b) of FIG. 8, the toners located at positions of the electrode portions 101*b* and 101*d* to which the image forming voltage Vp is applied receive the electrostatic force with respect to the image carrying member 3 direction by the electric field directed in the toner carrying member 2 direction.

The toners located at positions of the electrode portions 101*a*, 101*c* and 101*e* to which the non-image forming voltage V0 is applied receive the electrostatic force with respect to the toner carrying member 2 direction by the electric field directed in the image carrying member 3 direction.

By such an influence of the electrostatic force received from the electric fields, the toners are moved as shown in (a) of FIG. 8.

Further, the toner located between the electrode portion 101*b* to which the image forming voltage Vp is applied and the electrode portion 101*a* to which the non-image forming voltage V0 is applied is selectively placed, depending on the electric field formed by the associated electrode, in a carried state by the toner carrying roller 2 or in a carried state by the image carrying member 3. This is true for the toners located between adjacent two other electrode portions.

As described above, with respect to the image carrying member widthwise direction, the image formation is effected.

In the present invention, the toner image formation is effected by setting the toner carrying roller potential at 0 V and by applying the voltages, of the polarities identical and opposite to the toner charge polarity, to the image forming electrode but the present invention is not limited thereto.

In the case of the constitution in which the voltage is applied to the toner carrying roller 2, with respect to the potential of the toner carrying roller 2, it is possible to form the image by selectively applying the positive and negative potentials to the planar electrode 105.

(5) Image Forming Process in this Embodiment

Next, the image forming process which is a characteristic feature of this embodiment will be described. This embodiment is characterized in that more definite image formation is effected by changing the image forming voltage Vp and the non-image forming voltage V0 which are applied to the adjacent recording electrodes to control the direction of the electric field formed in the electrode space S. Details will be described below.

When the potential of the toner carrying roller 2 is Vt, a potential difference |Vp−Vt| with the image forming voltage Vp is referred to as an image forming potential difference. Further, a potential difference |Vt−V0| with the non-image forming voltage V0 is referred to as a non-image forming potential difference.

In the case where the image forming voltage Vp=60 V, the non-image forming voltage V0=−30 V and the toner carrying roller potential Vt=0V, the image forming potential difference |Vp−Vt|=60 V and the non-image forming potential difference |Vt−V0|=30 V are satisfied. In this case, a ratio between the image forming potential difference and the non-image forming potential difference, i.e., |Vp−Vt|:|Vt−V0|=30V:30V=2:1.

Part (a) of FIG. 9 shows a state of the electric field at a periphery of the electrodes in the case where the above potential differences are provided. Part (b) of FIG. 9 schematically illustrates the toner state formed depending on the electric field.

Part (a) of FIG. 9 shows the electric field in the case where the non-image forming voltage V0=−30 V is applied to the electrode portions 101*a*, 101*c* and 101*e* and the image forming voltage Vp=60 V is applied to the electrode portions 101*b* and 101*d*. Incidentally, the electrode portion 101 to which the image forming voltage Vp is applied is an image forming electrode, and the electrode portion 101 to which the non-image forming voltage V0 is applied is a non-image forming electrode. A position of a change point where the electric field toward the toner carrying roller 2 and the electric field toward the image carrying member 3 are switched is indicated by a broken line. Incidentally, at the change point, the direction of the electric field is switched with respect to the widthwise direction. The position of the change point is shifted from a center of the electrode space S toward the electrode portions 101*a*, 101*c* and 101*e* to which the non-image forming voltage V0 is applied. Based on FIG. 10, the position of the change point shifted depending on the electrode portions 101*a* and 101*b* and the applied voltage will be described. When the space between the adjacent electrodes is S, a distance S0 from an end of the electrode portion 101*a* to a position Y of the change point (hereinafter referred to as a change point distance) is S0=S×|Vt−V0|/|Vp−V0| (=|Vt−V0|/|Vp−Vt)|+|Vt−V0|). That is, the change point distance S0 changes depending on the ratio between the image forming potential difference |Vp−Vt| and the non-image forming potential difference |Vt−V0|. This is explained as follows. In the case where the voltages applied to the adjacent electrodes are the image forming voltage Vp and the non-image forming voltage V0, the potentials with respect to the potential Vt of the toner carrying roller 2 are different in polarity from each other.

Incidentally, the difference in polarity between the potential Vp and the potential V0 with respect to the potential Vt refers to a relationship such that one potential is negative (−) and the other potential is positive (+). In this case, between the adjacent electrode spaces S, there is a position where the potential is equal to the potential Vt of the toner carrying roller 2 but the position is moved in proportion to a magnitude of each of the potential differences |Vp−Vt| and |Vt−V0|. That is, the position where the potential is equal to the potential Vt of the toner carrying roller 2 becomes the change point, so that the electric field toward the toner carrying roller 2 is formed at the image forming electrode side, and the electrode toward the image carrying member 3 is formed at the non-image forming electrode side with respect to the change point.

In the case of the potential relationship as described with reference to (a) of FIG. 9, the change point distance is S0=S×(⅓) and S is 40 μm and thus S0 is 13.35 μm. At such a position, when the direction of the electric field has the change point, as shown in (b) of FIG. 9, in accordance with the electric field toward the toner carrying roller, formed by the image forming electrode portions 101*b* and 101*d*, the negative toner receives the electrostatic force toward the image carrying member, so that the toner movement toward the image carrying member is effected. Further, in accordance with the electric field, toward the image carrying member, formed by the non-image forming electrode portions 101*a*, 101*c* and 101*e*, the toner receives the electrostatic force toward the toner carrying roller, so that the non-image portion is formed. As a result, a widthwise distance (dot width) of the toner moved on the image carrying member is 93.3 μm, and a space width between the toner images is 66.7 μm. This means that the dot width and the space width can be formed with a higher resolution than the case of the image width (dot width) for one pixel of 80 μm and the space width of 80 μm which are depending on the resolution of the image forming apparatus in this embodiment.

Further, in this embodiment, adjustment for increasing the dot width at Vp=+60 V and V0=−30 V was performed. For example, when the image forming voltage is Vp=+30 V and the non-image forming voltage is V0=−60 V, the dot width and the space width can be made 66.7 μm and 93.3 μm, respectively, so that it is also possible to effect control for decreasing the dot width.

In the following, the image width force pixel obtained in the case where the image forming voltage Vp and the non-image forming voltage V0 in various settings is shown in Table 1. Further, dot images (Example 1-1 and Examples 2-1 to 2-4), obtained under representative conditions of those shown in Table 1, the dot images are schematically illustrated in associated with the electrode positions. Here, description will be made on the assumption that the non-image forming voltage V0 is applied to the electrodes adjacent to the image forming electrode. Setting common to the respective conditions is as follows.

Image carrying member movement speed: 80 mm/sec
Electrode width L: 40 μm
Electrode space (width) S: 40 μm
Image forming voltage on timing: t1
Image forming voltage off timing: t2
Image forming voltage application time (t2=t1): 1.0 msec

TABLE 1

| Example | Vt | Vp | V0 | \|Vt − Vt\| | \|Vt − V0\| | IW*[1] |
|---|---|---|---|---|---|---|
| 1-1 | 0 V | 50 V | −50 V | 50 V | 50 V | 80 μm |
| 1-2 | 0 V | 50 V | −25 V | 50 V | 25 V | 93.3 μm |
| 1-3 | 0 V | 75 V | −50 V | 75 V | 50 V | 88 μm |
| 2-1 | 0 V | 60 V | −30 V | 60 V | 30 V | 93.3 μm |
| 2-2 | 0 V | 30 V | −60 V | 30 V | 60 V | 66.7 μm |
| 2-3 | 0 V | 80 V | −20 V | 80 V | 20 V | 104 μm |
| 2-4 | 0 V | 30 V | −120 V | 30 V | 120 V | 56 μm |
| 3-1 | 50 V | 100 V | 0 V | 50 V | 50 V | 80 μm |
| 3-2 | 50 V | 80 V | −10 V | 30 V | 60 V | 66.7 μm |
| 3-3 | 50 V | 130 V | 30 V | 80 V | 20 V | 104 μm |

Vt: toner carrying roller potential
Vp: image forming voltage
|Vp − Vt|: image forming potential difference
V0 = non-image forming voltage
|Vt − V0|: non-image forming potential difference
*[1]"IW" represents the image width for one pixel.

In Table 1, Examples 1-1 is the case where the values of |Vp−Vt| and |Vt−V0| are equal to each other, i.e., shows a voltage application pattern corresponding to a basic resolution of the image forming apparatus. Under voltage settings shown in Examples 1-2 and 1-3, only either one of Vp and V0 is changed, i.e., the ratio of |Vp−Vt|:|Vt−V0| is changed. Therefore, in the case where the image (dot) width is intended to be largely changed, there is a need to largely change the voltage to be controlled, of Vp and V0. However, due to the reason described later, fog occurs when V0 is excessively small and the image density is decreased when Vp is excessively small and therefore clear line and dot cannot be reproduced.

Examples 2-1 to 2-4 are the case where both of Vp and V0 are changed. In this case, each of change amounts of Vp and V0 is small, the ratio of |VP−Vt|:|Vt−V0| can be increased. Therefore, these Examples are effective in the case where the image (dot) width is largely changed by a small change amount of the voltage.

Further, even in a method in which a predetermined potential Tt is applied to the toner carrying roller as in Examples 3-1 to 3-3, when Vp and Vt are applied so as to provide the potential difference with respect to Vt, it is possible to adjust the image (dot) width. In this case, as in Examples 3-1 and 3-3, all the potentials to be set can be controlled to have the same polarity, a circuit constitution in which the voltage applied to the electrodes are controlled can be simplified.

As described above, by changing the image forming voltage Vp and the non-image forming voltage V0 which are applied to the adjacent electrodes in accordance with the various settings as shown in Table 1, in either case, it is possible to increase and decrease the image (dot) width for one pixel.

Here, a controllable voltage regions of the image forming voltage Vp and the non-image forming voltage V0 will be described. As described above, in the image forming process of the present invention, the voltages applied to the planar electrode 105 are controlled so that the potential difference between the toner carrying roller 2 and the image carrying member 3 is not more than the electric discharge start voltage. Therefore, there is a need to control the voltages so as to be not more than the voltage at which the space electric discharge is generated by the image forming potential difference |Vp−Vt| or the non-image forming potential difference |Vt−V0|. Further, there is also a need to control the voltages so as to be not more than the voltage at which leakage between the adjacent electrodes can be suppressed.

Further, in the case where the image (dot) width for one pixel is narrowed as small as possible, it will be considered that the image forming voltage Vp is set at a value as small as possible so that the ratio of the image forming potential difference |Vp−Vt| to the non-image forming potential difference |Vt−V0| is decreased. When the image forming potential difference |Vp−Vt| is decreased, a sufficient electrostatic force for moving the toner from the toner carrying roller 2 onto the image carrying member 3 in the toner movement area Imd cannot be provided. In (a) of FIG. 12, the image density when the image forming potential difference |Vp−Vt| is changed under the conditions in this embodiment, so that it is understood that the image density is lowered when the potential difference becomes small. Therefore, in this embodiment, as the image forming potential difference |Vp−Vt|, there is a need to apply the image forming voltage Vp so as to provide the potential difference of about 30 V or more.

Similarly, when the non-image forming potential difference |Vt−V0| becomes small, a sufficient electrostatic force for returning the toner, once moved to the image carrying member in the toner movement area Imd, to the toner carrying roller 2 cannot be provided, so that a degree of fog at the non-image portion is worsen ((b) of FIG. 12). Therefore, in this embodiment, as the non-image forming potential difference |Vt−V0|, there is a need to apply the non-image forming voltage V0 so as to provide the potential difference of about 20 V or more.

Incidentally, depending on a toner shape, a charging performance, charging property and surface property of the toner carrying roller or a surface property of the image carrying member, a non-electrostatic depositing force acting on each of the members is different. Therefore, the electrostatic force required for moving the toner varies depending on the condition of the image forming apparatus. Accordingly, limit values of the image forming potential difference |Vp−Vt| and the non-image forming potential difference |Vt−V0| for satisfying the image density and the degree of fog are not limited to those described above.

(6) Comparison of Effect of Application of Control in this Embodiment

The effect in the case where the control in this embodiment is applied will be described with reference to schematic views of (a) to (d) of FIG. 13. Here, a toner image obtained by reading an image pattern, shown in (a) of FIG. 10, constituted by 10 pixels with respect to the image carrying member widthwise direction and 10 pixels with respect to the image carrying member movement direction and then by being formed on the image carrying member is compared. Part (b) of FIG. 13 shows the toner image in the case where Vp=50 V is always applied to the image forming electrodes and V0=−50 V is always applied to the non-image forming electrodes. The potential of the toner carrying roller is Vt=0 V. Part (c) of FIG. 13 shows the toner image in the case where the control in this embodiment is applied. Part (d) of FIG. 13 shows values of the voltages applied to the electrodes corresponding to the respective pixels. In the control in this embodiment, when the image information for forming the toner image from the image pattern is obtained, the potentials of the image portion electrodes and the non-image portion electrodes corresponding to a contour portion of the image pattern are variably controlled. The underlined voltage values represent electrode portions where the control in this embodiment is effected. Further, a curve in each of (b) and (c) of FIG. 13 is a contour line of the image pattern of (a) of FIG. 13.

As apparent from FIG. 13, by applying the control of this embodiment, it is understood that the stepwise contour line represented when the image pattern controlled by a curve is drawn can be smoothly reproduced more than the conventional constitution.

In this embodiment, when the image information for forming the toner image is obtained, depending on the image information, at least one of the potential differences |Vp−Vt| and |Vt−V0| is variably controlled. Here, the toner carrying member potential is Vt, the potential of the electrode for forming the image portion is Vp and the potential of the electrode for forming the non-image portion is V0.

Incidentally, a constitution in which the user can select whether or not the control in this embodiment is effected may also be employed. For example, when the image pattern as shown in (a) of FIG. 13 is read, the toner image shown in (b) of FIG. 13 may be formed when the user selects the resolution of 600 dpi and the toner image as shown in (c) of FIG. 13 may be formed when the user selects the resolution of 1200 dpi.

(7) Another Application Example of this Embodiment

The arrangement of the planar electrode 105 with respect to the image carrying member movement direction will be mentioned. From the above-described image forming process, it is clear that at least a part of the planar electrode 105 is present in the toner movement area Ind. In this embodiment, Imd is, as shown in FIG. 4, defined as the distance from the downstream end id of the toner contact area Ic to the planar electrode contact downstream position ie0. For example, as shown in FIG. 14, in the case where the electrode downstream end ie0 is extended toward the image carrying member downstream direction, the toner movement area Imd is not extended in the downstream direction but the downstream end of the toner movement area Imd is determined by a toner movement limit position indicated by iL. The toner movement limit position iL is the position where the toner can move from the toner carrying roller 2 to the image carrying member 3 when the image forming voltage Vp is applied. An electrode portion (iL to ie0) located downstream of the toner movement limit position iL cannot provide the electrostatic force such as affect the toner movement between the toner carrying roller 2 and the image carrying member 3 even when the voltage is applied. Therefore, the toner carrying state on the image carrying member at the toner movement limit position is maintained.

By such an electrode arrangement, the image position is not deviated between the respective electrodes even in the case where the downstream positions of the respective electrodes arranged in the image carrying member widthwise direction varies depending on a variation in manufacturing or in the case where the electrode arrangement is tilted with respect to the toner carrying roller 2.

Further, as shown in FIG. 14, there is no problem even when the electrode contact voltage position ieu of the planar electrode 105 is located upstream of the upstream end iu of the toner contact area Ic. The image finally carried on the image carrying member is formed by the toner movement in the downstream toner movement area Imd. Such disposition that the electrodes are sufficiently extended to the upstream position and the downstream position has the advantage that the downstream toner movement area Imd can be formed with reliability even in the case where the position of the planar electrode 105 is somewhat deviated in the image carrying member movement direction.

(Type of Electrode)

In this embodiment, as the image forming electrode portion 4, the planar electrode 105 is used but, e.g., it is also possible to employ a constitution, as shown in FIG. 15, in which a needle-like electrode portion 31 is provided downstream of the toner contact area Ic with respect to the image carrying member movement direction. The needle-like electrode portion 31 is a linear electrode of phosphor bronze or tungsten which has a hemisphere surface at its end contacting the image carrying member 3 and is about 50-100 μm in length.

In this constitution, the needle-like electrode portion 31 is held by a supporting member 32 of an insulating resin material and includes a plurality of needle-like electrodes arranged in the image carrying member widthwise direction at regular intervals. In such a constitution, at the needle-like electrode position ie, the toner movement is controlled between the toner carrying roller 2 and the image carrying member 3 to effect the image formation.

(Contact State of Electrode)

In the constitution in this embodiment, the electrode portion 101 of the planar electrode and the inner surface of the image carrying member 3 are contacted to each other. For example, the electrode portion 101 and the image carrying member inner surface may also be spaced with a slight distance by providing an electrode-image carrying member spacing member or the like formed, of an insulating material, so as to extend over a longitudinal direction of the planar electrode. In this case, the spacing (gap) may desirably be about 20 μm.

In such a constitution, there is a need to make the voltage applied to the electrode higher than that in the constitution in which the electrode portion and the image carrying member inner surface are contacted to each other but on the other hand, there is the advantage such that abrasion of the electrode portion by sliding between the electrode portion and the image carrying member is prevented.

Embodiment 2

Constitutions of an image forming apparatus and a planar electrode which are applicable to this embodiment are the same as those in Embodiment 1 and therefore will be omitted from description. Further, portions common to Embodiments 1 and 2 are represented by the same reference numerals or symbols.

In Embodiment 1, the first (dot) width or space width for one pixel with respect to the image carrying member widthwise direction was adjusted by shifting the electric field change point by the change of the image forming voltage Vp and the non-image forming voltage V0. This embodiment is characterized in that the control in Embodiment 1 is combined with control for changing a length of the first (dot) with respect to the image carrying member movement direction to effect high definition image formation.

As already described in Embodiment 1, with respect to the image formation for the image carrying member movement direction, it is possible to form the image with the length of X=V×T (mm) at the image carrying member process speed of V (mm/s) in accordance with the timing chart of the voltage applied to the electrode as shown in FIG. 6.

Therefore, by shortening the voltage application time T(s) to the electrode, the first (dot) length with respect to the image carrying member movement direction is freely adjustable.

In the following, an image pattern obtained in the case where the image forming voltage Vp and the non-image forming voltage V0 are changed and simultaneously therewith the application time T(s) is changed will be described. The values of the applied voltages Vp and V0, the application time T(s) and the width and length of the image obtained under each of conditions are shown in Table 2 below. Further, the images obtained under the respective conditions are schematically illustrated in FIG. 6 in association with the electrode positions. Here, only the case where the toner carrying roller potential is Vt=0 and both of the image forming voltage Vp and the non-image forming voltage V0 are changed simultaneously will be described. With respect to the case where the toner carrying roller potential Vt is changed and the case where either one of Vp and V0 is changed, the constitution is the same as that in Embodiment 1. Setting common to the respective conditions is as follows.

Image carrying member movement speed: 80 mm/sec
Toner carrying roller potential Vt: 0 V
Electrode width L: 40 μm
Electrode space (width) S: 40 μm
Image forming voltage on timing: t1
Image forming voltage off timing: t2
Voltage application time T: t2−t1

TABLE 2

| Example | Vp | V0 | \|Vp − Vt\| | \|Vt − V0\| | T | IW/L*[1] |
|---|---|---|---|---|---|---|
| 6-1 | 60 V | −30 V | 60 V | 30 V | 0.5 msec | 93.3 μm/40 μm |
| 6-2 | 60 V | −30 V | 60 V | 30 V | 0.25 msec | 93.3 μm/20 μm |
| 6-3 | 30 V | −90 V | 30 V | 90 V | 0.5 msec | 60 μm/40 μm |
| 6-4 | 30 V | −90 V | 30 V | 90 V | 0.25 msec | 60 μm/20 μm |

Vt: toner carrying roller potential
Vp: image forming voltage
|Vp − Vt|: image forming potential difference
V0 = non-image forming voltage
|Vt − V0|: non-image forming potential difference
*[1]"IW/L" represents the image width and length for one pixel As shown in FIG. 16, by adjusting the application time T(s) simultaneously with the change of the image forming voltage Vp and the non-image forming voltage V0 for the adjacent electrodes, it is possible to finely control the formed image (dot) width and length for one pixel.

Next, the effect of the case where the control in Embodiment 2 is applied will be described with reference to schematic views of (a) and (b) of FIG. 17. The image pattern used is the same as that of (a) of FIG. 3 in Embodiment 1. Part (a) of FIG. 17 shows an example to which the control in Embodiment 2 is applied. Further, (b) of FIG. 17 shows an enlarged portion of a box shown in (a) of FIG. 7 and shows values of the voltages applied to the respective electrodes. Incidentally, the control shown in (b) of FIG. 17 shows the example of Embodiment 2 and thus the control method is not limited thereto but another control method such that voltage application pulses for the respective voltages are renewed in a further short period may also be used.

By comparison of (a) of FIG. 17 with (b) of FIG. 13, it is understood that with respect to the pattern subjected to the image formation in accordance with the control in Embodiment 2, the stepwise contour line appearing when the curve is drawn can be further smoothly reproduced more than Embodiment 1.

As in Embodiment 1, fine image formation can be effected by further changing the application time of the voltage applied to the electrode depending on the image information.

Embodiment 3

Constitutions of an image forming apparatus and a planar electrode which are applicable to this embodiment are the same as those in Embodiment 1 and therefore will be omitted from description.

This embodiment is characterized in that a center position of the image (dot) is shifted by changing the image forming voltage Vp and the non-image forming voltage V0 in the case where V0 is present at each of adjacent portions of Vp, i.e., when the image (dot) for one pixel is formed in an isolation manner.

In the following, the image pattern obtained in the case where the non-image forming voltages V0 adjacent to the image forming voltage Vp are changed will be described. Here, the non-image forming voltages adjacent to the image forming voltage Vp are referred to as V01 and V02. Values of Vp, V01 and V02, the image width obtained when these values are changed, and the center position of the image (dot) for one pixel are shown in Table 3. Further, the images obtained under the respective conditions are schematically illustrated in FIG. 18. With respect to the center position of the image (dot), on the basis of the image forming voltage Vp, an amount of shifting toward the right-hand electrode V02 on the drawing sheet is represented by a positive (+) value. Further, in Table 3 and FIG. 18, Ex. 1-1 is shown as an example in which the image width and the center position are not changed. Setting common to the respective conditions is as follows.

Image carrying member movement speed: 80 mm/sec
Toner carrying roller potential Vt: 0 V
Electrode width L: 40 μm
Electrode space (width) S: 40 μm
Image forming voltage on timing: t1
Image forming voltage off timing: t2
Voltage application time (t2−t1): 1.0 msec

TABLE 3

| Ex. | Vp | V0 | V02 | \|Vp − Vt\| | \|Vt − V0\| | \|Vt − V02\| | IW/CP*[1] |
|---|---|---|---|---|---|---|---|
| 1-1 | −50 V | 50 V | −50 V | 50 V | 50 V | 50 V | 80 μm/0 μm |
| 8-1 | −120 V | 60 V | −30 V | 120 V | 60 V | 30 V | 80 μm/+6.7 μm |
| 8-2 | −180 V | +60 V | −20 V | 180 V | 60 V | 20 V | 80 μm/+10 μm |
| 8-3 | −150 V | 50 V | −50 V | 150 V | 50 V | 50 V | 70 μm/+5 μm |
| 8-4 | −60 V | +60 V | −20 V | 60 V | 60 V | 20 V | 90 μm/+5 μm |

Vt: toner carrying roller potential
Vp: image forming voltage
|Vp − Vt|: image forming potential difference
V01 and V02 = non-image forming voltage
|Vt − V01| and |Vt − V02|: non-image forming potential difference
*[1]"IW/CP" represents the image width and center position for one pixel As shown in FIG. 18, the center position of the image (dot) can be shifted by changing the non-image forming voltages V01 and V02 applied to the electrodes adjacent to the electrode for the image forming voltage Vp. In Examples 8-1 and 8-2, only the center position is shifted without changing the image width. Further, as shown in Examples 8-3 and 8-4, it is also possible to change the image width and then to shift the center position.

Next, the effect in the case where the control in this embodiment is applied will be described with reference to (a) to (d) of FIG. 19. The image shown in (a) of FIG. 19 is an image data for an oblique line controlled with a width corresponding to about one pixel width. By using this data, the toner images formed on the image carrying member are compared. Part (b) of FIG. 19 shows the toner image in the case where Vp=50 V is always applied to the image forming electrode and V0=−50 V is always applied to the non-image forming electrodes. The dot on a one-pixel unit basis is always formed at the electrode center and therefore when an oblique line is reproduced, the resultant image is such that two vertical lines are stepwisely connected at their closing edges. Part (c) of FIG. 19 shows an example to which the control in this embodiment is applied. Further, with respect to the example of (c) of FIG. 19, the image forming voltages and the non-image forming voltages applied to the respective electrodes are shown in (d) of FIG. 19. As apparent from the comparison of (c) and (d) of FIG. 19 with (b) of FIG. 19, it is understood that the oblique line is further smoothly reproduced by applying the control in this embodiment.

INDUSTRIAL APPLICABILITY

According to the present invention, by the above-described constitutions, the change point between the electric field direction in which the image portion is formed and the electric field in which the non-image portion is formed is shifted depending on the ratio of the image forming potential difference represented by |Vp−Vt| and the non-image forming potential difference represented by |Vt−V0|. As a result, it becomes possible to increase and decrease the image (dot) width for one pixel depending on the resolution of the image forming apparatus.

The invention claimed is:

1. An image forming apparatus comprising:
a toner carrying member for carrying a toner;
an image carrying member on which a toner image is formed with the toner;
a plurality of divided electrode portions arranged along a direction which crosses a movement direction of said image carrying member and provided at a position in which said electrode portions oppose said toner carrying member via said image carrying member interposed therebetween, wherein said electrode portions are supplied with a voltage on the basis of image information to move the toner between said toner carrying member and said image carrying member thereby to form the toner image; and
a controller for variably controlling at least one of potential differences |Vp−Vt| and |Vt−V0| depending on the image information, where a potential of said toner carrying member is Vt, a potential of one of said electrode portions for forming an image portion is Vp, and a potential of another of said electrode portions for forming a non-image portion adjacent to said one electrode portion for forming the image portion is V0.

2. An image forming apparatus according to claim 1, wherein when said other electrode portion for forming the non-image portion is provided at each of both sides of said one electrode portion for forming the image portion, said controller effects control so that values of potential differences |Vt−V01| and |Vt−V02| are different from each other, where a potential of said other electrode portion for forming the non-image portion provided at one of the sides is V01 and a potential of said other electrode portion for forming the non-image portion provided at the other of the sides is V02.

3. An image forming apparatus according to claim 1 or 2, wherein when said controller variably controls the potential differences, an application time of the voltage is changed depending on the image information.

4. An image forming apparatus according to claim 1 or 2, wherein said toner carrying member and said image carrying member are provided in contact with each other to form a toner contact area, and
wherein a toner movement area in which the toner is moved is present downstream of the toner contact area with respect to the movement direction of said image carrying member.

5. An image forming apparatus according to claim 1 or 2, wherein said electrode portions and said image carrying member are provided in contact with each other.

6. An image forming apparatus according to claim 1, wherein said controller variably controls both the potential difference |Vp−Vt| and the potential difference |Vt−V0| depending on the image information.

* * * * *